US008151401B2

(12) United States Patent
Cheyne

(10) Patent No.: US 8,151,401 B2
(45) Date of Patent: Apr. 10, 2012

(54) VARIABLE STRENGTH MAGNETIC WINDOW CLEANING DEVICE

(76) Inventor: Brian Cheyne, Pittsford, NY (US)

( * ) Notice: Subject to any disclaimer, the term of this patent is extended or adjusted under 35 U.S.C. 154(b) by 839 days.

(21) Appl. No.: 12/240,850

(22) Filed: Sep. 29, 2008

(65) Prior Publication Data

US 2009/0106925 A1 Apr. 30, 2009

Related U.S. Application Data

(60) Provisional application No. 60/982,579, filed on Oct. 25, 2007.

(51) Int. Cl.
*A47L 1/12* (2006.01)

(52) U.S. Cl. ..... 15/220.2

(58) Field of Classification Search ..... 15/220.2
See application file for complete search history.

(56) References Cited

U.S. PATENT DOCUMENTS

| | | | | |
|---|---|---|---|---|
| 2,634,444 | A | 4/1953 | Coleman | |
| 2,700,171 | A | 1/1955 | Wiest, Jr. | |
| 3,201,816 | A | 8/1965 | Bryce | |
| 3,296,645 | A | 1/1967 | Shore | |
| 3,492,685 | A | 2/1970 | Curzon | |
| 3,600,737 | A | 8/1971 | Shore | |
| 3,609,793 | A | 10/1971 | Kaftan | |
| 3,731,337 | A | 5/1973 | Doyel | |
| 3,751,750 | A | 8/1973 | Kaftan | |
| 3,759,621 | A | 9/1973 | De Carlo | |
| 3,983,591 | A | 10/1976 | Ohtaki | |
| 4,144,091 | A | 3/1979 | Tran | |
| 4,977,637 | A | 12/1990 | Demers | |
| 6,206,978 | B1 * | 3/2001 | Tsui | 134/8 |
| 6,348,104 | B1 | 2/2002 | Bakker | |
| 6,634,052 | B2 | 10/2003 | Hanson | |
| 7,506,612 | B2 * | 3/2009 | Enoch et al. | 119/264 |
| 7,725,977 | B2 * | 6/2010 | Remer | 15/103 |
| 2006/0090278 | A1 * | 5/2006 | Hang | 15/220.2 |
| 2008/0256735 | A1 * | 10/2008 | Campbell | 15/220.2 |

OTHER PUBLICATIONS

Hagen, Algae Magnet Cleaner, website, Sep. 17, 2008, 1 page, US.

* cited by examiner

*Primary Examiner* — Randall Chin
(74) *Attorney, Agent, or Firm* — Tracy Jong Law Firm; Tracy P. Jong; Cheng Ning Jong

(57) ABSTRACT

There is disclosed a variable strength magnetic window cleaning device having a master and slave unit utilizing magnetic force to simultaneously clean both the inside and outside panes of a window. When a user moves the master unit from inside, the slave unit follows the master unit along the outside window, thus cleaning both sides of the window panes simultaneously. A replaceable cleaning surface such as pre-moistened disposable wipe is secured across the engagement surface area and contacts the window surface to effect the cleaning.

13 Claims, 16 Drawing Sheets

VARIABLE STRENGTH MAGNETIC WINDOW CLEANING DEVICE

CROSS REFERENCE TO RELATED APPLICATION AND PRIORITY CLAIM

This application claims the benefit of provisional application U.S. Ser. No. 60/982,579 filed on Oct. 25, 2007.

BACKGROUND OF THE INVENTION

1. Field of the Invention

This invention relates generally to window cleaning devices and more particularly to simultaneous inner and outer window surface cleaning with master and slave units being mutually magnetically attracted to each other on opposite sides of a window.

2. Description of Related Art

The related art falls into two categories. One category relates to the type of magnet, configuration of magnetic poles and/or their alignments. U.S. Pat. No. 3,296,645 claims adjacent magnets of alternating polarity; U.S. Pat. No. 3,492,685 claims the use of horseshoe magnets; U.S. Pat. No. 3,600,737 claims angularly disposed halves; and U.S. Pat. No. 3,731,337 discloses the use of annular magnets. The current invention utilizes a new technological advancement in magnetism which in independent of magnet type, shape, and/or polarity configurations obsolete.

The second category of related art pertains to the method used to clean the window panes. U.S. Pat. No. 2,634,444 requires the use of liquid cleaner and a squeegee; U.S. Pat. No. 2,700,171 requires the use of a sponge and water; U.S. Pat. No. 3,751,750 discloses the use of a specially designed cleaning material made through a specific process using polyethylene chips on absorbent paper; U.S. Pat. No. 3,759,621 discloses magnetic units including reservoirs for window cleaning fluid; U.S. Pat. No. 3,983,591 discloses a brush on the cleaning units which requires a motor run by electricity; U.S. Pat. No. 4,144,091 discloses a container on the outside cleaning unit having compartments for cleaning elements; and U.S. Pat. No. 4,977,637 discloses the use of a window cleaning device containing an inside unit and two outside units, one to clean and the other to squeegee. U.S. Pat. No. 3,201,816 to Bryce entitled "Storm Window Washing Device" discloses a storm window cleaner that is limited to cleaning a single pane at a time.

The current invention utilizes the new advances made in cleaning windows over the past twenty years. The current invention does not require reservoirs, soaps, liquid sprays, squeegees, sponges, etc. The current invention makes cleaning the inside and outside panes of residential windows easier than any prior art because it utilizes pre-moistened window cleaning wipes which are widely available and very popular.

U.S. Pat. No. 6,634,052 to Hanson and U.S. Pat. No. 6,348,104 discloses fish tank algae cleaning devices. While these devices simultaneously clean two sides of a glass aquarium wall in a similar fashion to the present invention, they are not designed to address the problems (e.g., lack of adjustable magnetism to allow for various glass thicknesses) or provide the advantages (allowing disposable cleaning wipes) of the present invention. Each of these devices is manufactured in various versions each having a different magnetic strength to be used on certain aquarium sizes having walls of a certain thickness. These prior art devices do not anticipate a variable strength magnetic force or a universal type device.

While these prior art devices are presumably adequate for their intended purposes, there has been recent developments in both magnets and window cleaning methods that have made the prior art outdated. The current invention utilizes these new developments and offers a significant improvement over the prior art. In addition, none of these prior art devices are configured adequately for use in the narrow spaces typical of many residential windows including single, double and triple pane windows, storm windows and doors, including both single and double hung designs, and casement windows. Additionally, windows come in various thicknesses. Many residential homes have window panes of varied thicknesses, some single pane others double or even triple pane. The current device is the only device to claim to be able to adjust magnetic strength so that it can clean both single and double pane windows of various thicknesses.

Thus it is desirable to provide a window cleaning device that improves upon the prior art and eliminates one or more of its shortcomings and limitations.

SUMMARY OF THE INVENTION

In accordance with the present invention, there is disclosed a novel variable strength magnetic window cleaning device having, in combination, a master unit and a slave unit mutually magnetically attracted into close proximity wherein the master unit and slave unit each have at least one rare earth magnet operably affixed to a housing thereof, wherein the at least one rare earth magnet of the master unit magnetically attracts to at least one mating rare earth magnet in the slave unit, the master unit and slave unit each have a replaceable cleaning surface situated thereon, the replaceable cleaning surfaces being a disposable wipe premoistened with cleaning solution, the master unit and slave unit each have a plurality of attachment members configured to receive and removably the secure replaceable cleaning surfaces thereon, the housing of the master unit further comprises a handle, and the housing of the slave unit has a thickness of less than about one inch. In one aspect, the master and slave units further comprise a magnet plate for holding the rare earth magnets.

There is also provided an alternate embodiment of a variable strength magnetic window cleaning device having, in combination, a master unit and a slave unit magnetically attracted into close proximity wherein the master unit comprises a handle, a first engagement surface, a first rare earth magnet and a second rare earth magnet and wherein the first rare earth magnet and the second rare earth magnet are disposed symmetrically about an X and a Y axis of the first engagement surface, the first rare earth magnet has a north polarity facing the first engagement surface, the second rare earth magnet has a south polarity facing the first engagement surface, the slave unit comprises a second engagement surface and a third engagement surface, a third rare earth magnet and a fourth rare earth magnet and wherein the slave unit has a thickness between the second engagement surface and the third engagement surface of less than about one inch, the third rare earth magnet and the fourth rare earth magnet are disposed symmetrically about an X and a Y axis of the second engagement surface, the third rare earth magnet has a north polarity facing the second engagement surface, the fourth rare earth magnet has a south polarity facing the second engagement surface, such that the first and second rare earth magnets of the master unit magnetically attract the third and fourth rare earth magnets in the slave unit, the third and fourth rare earth magnets are disposed asymmetrically with respect to the midpoint about the thickness of the slave unit and along a plane parallel with the second and third engagement surfaces, the master unit has a first replaceable cleaning surface situated thereon and in contacting engagement with the first engagement surface, wherein the master unit further has a plurality of attachment members configured to receive and removably the secure the first replaceable cleaning surface thereon, and the slave unit has a second replaceable cleaning surface situated thereon, the second engagement surface and third engagement surface are configured for receiving the second replaceable cleaning surface.

This invention will simplify cleaning various types of residential windows including storm, sliding, single or double hung, single or double pane, and the like. The adjustment of the distance between opposing magnets via the magnetic adjusting mechanism allows a user to create a magnetic force that easily glides across a window surface.

It is an object of the present invention to provide a window cleaning assembly that has selectively adjustable magnetism such that it is neither too great so as to restrict smooth movement of the cleaning device across a window surface nor too weak so as to cause the outside cleaning unit to fall from the window due to the absence of sufficiently strong magnetic forces.

It is an object of the present invention to provide a window cleaning assembly that is capable of cleaning storm windows without having to remove them from their track.

It is a further object of the present invention to provide a window cleaning assembly that requires no additional cleaning agents, rather, simply a pre-moistened disposable wipe.

It is a further object of the present invention to provide a window cleaning assembly that eliminates wheeled parts and use of a sponge.

It is a further object of the present invention to provide a window cleaning assembly that speeds the process of window cleaning by utilizing reusable or disposable window wipes and eliminates these steps and the need for a separate drying component (squeegee).

It is a further object of the present invention to provide a window cleaning assembly that incorporate neodymium and other rare earth magnets.

It is a further object of the present invention to provide a window cleaning assembly that does not require a device that interferes with the cleaning surface area or which causes the master-slave units to "skip".

It is a further object of the present invention to provide a window cleaning assembly that does not restrict the user to a specific cleaning agent but rather allows the user to use any of the many commonly used premoistened or dry cleaning wipes, cleaning cloths or paper towels.

It is a further object of the present invention to provide a window cleaning assembly that allows the user to fasten buffers or other drying agents to the master and slave units to enhance the window cleaning process and results.

It is a further object of the present invention to provide a window cleaning assembly that affixes the cleaning wipe or paper towel prior to placement of the window cleaning assembly on the window allowing for cleaning of otherwise inaccessible windows such as roll out windows, storms, and typical residential windows where cleaning the outside pane of glass requires a slim fitting device.

It is a further object of the present invention to provide a window cleaning assembly that eliminates the need for reservoirs, cleaning containers and/or cleaning fluids because it utilizes disposable or reusable wipes making it more efficient, cost effective and easier to use.

It is a further object of the present invention to provide a window cleaning assembly that requires no electricity or motorized brushes, rather, employs just a simple disposable or reusable wipe that can reach the outside panes of glass even in tight spaces such as between storm and screen windows.

It is a further object of the present invention to provide a window cleaning assembly that has only two components, thus rendering it more cost effective for the manufacturer and practical for the user.

It is a further object of the present invention to provide a window cleaning assembly that is lighter weight and/or has greater magnetic strength than a comparable device with other magnet varieties.

It is a further object of the present invention to provide a window cleaning assembly having a master and slave unit that each may be used as separate and individual components to clean a single surface.

It is yet another object of the present invention to provide a window cleaning assembly that may be used with windows of varying thicknesses and configurations.

It is yet another object of the present invention to provide a window cleaning assembly that is durable and reliable.

It is yet another object of this invention to provide a window cleaning assembly that is economical from the viewpoint of the manufacturer and consumer, is susceptible of low manufacturing costs with regard to labor and materials, and which accordingly is then susceptible of low prices for the consuming public, thereby making it economically available to the buying public.

Whereas there may be many embodiments of the present invention, each embodiment may meet one or more of the foregoing recited objects in any combination. It is not intended that each embodiment will necessarily meet each objective.

Thus, having broadly outlined the more important features of the present invention in order that the detailed description thereof may be better understood, and that the present contribution to the art may be better appreciated, there are, of course, additional features of the present invention that will be described herein and will form a part of the subject matter of the claims appended to this specification.

In this respect, before explaining at least one embodiment of the invention in detail, it is to be understood that the invention is not limited in its application to the details of construction and the arrangements of the components set forth in the following description or illustrated in the drawings. The present invention is capable of other embodiments and of being practiced and carried out in various ways. Also it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent construction insofar as they do not depart from the spirit and scope of the conception regarded as the present invention.

BRIEF DESCRIPTION OF THE DRAWINGS

The invention will be described by reference to the specification and the drawings, in which like numerals refer to like elements, and wherein.

The drawings are not to scale, in fact, some aspects have been emphasized for a better illustration and understanding of the written description.

DETAILED DESCRIPTION OF THE INVENTION

Figure 1:
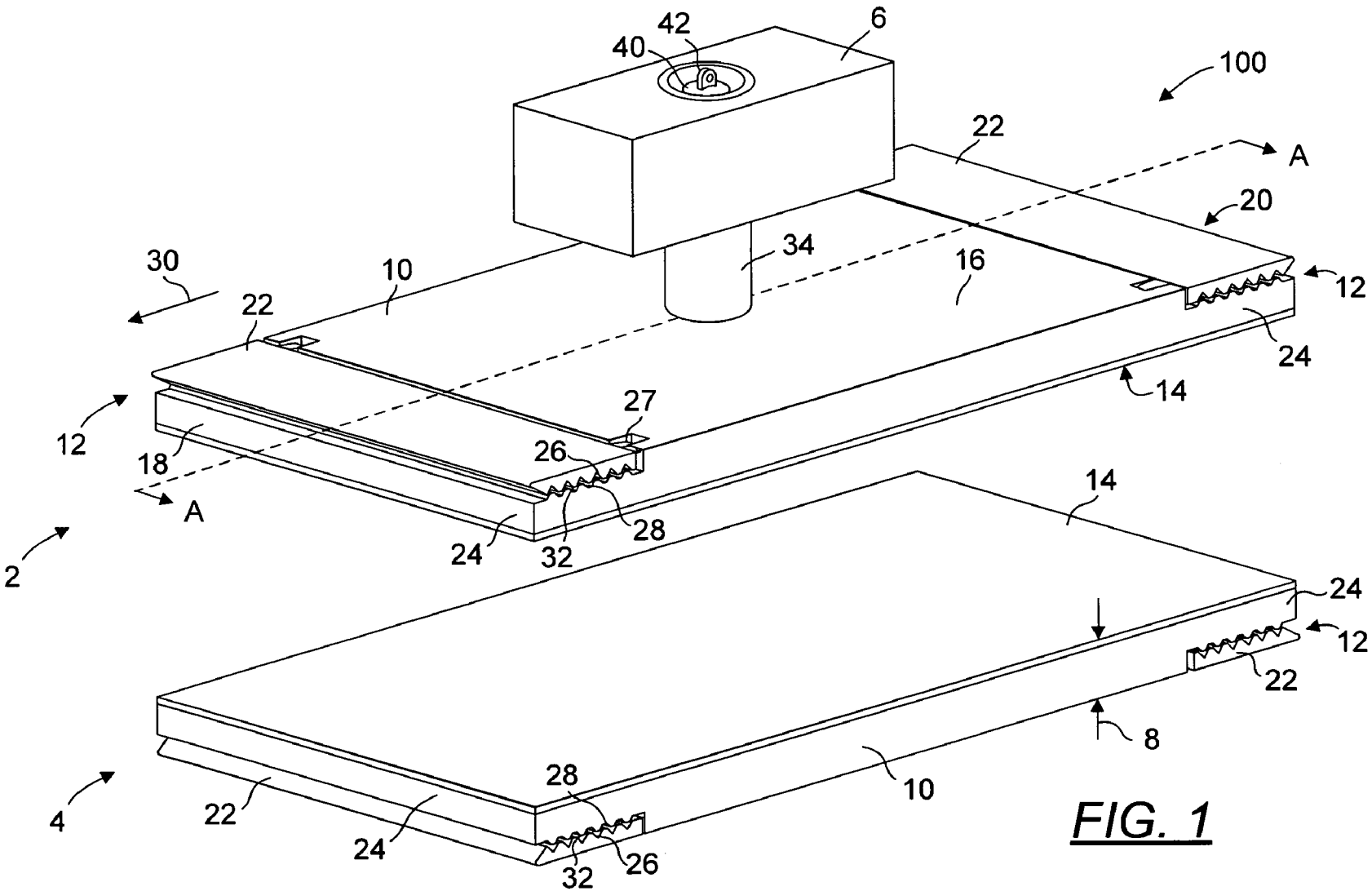
FIG. 1 is a perspective view of a window cleaning assembly.
Figure 2:
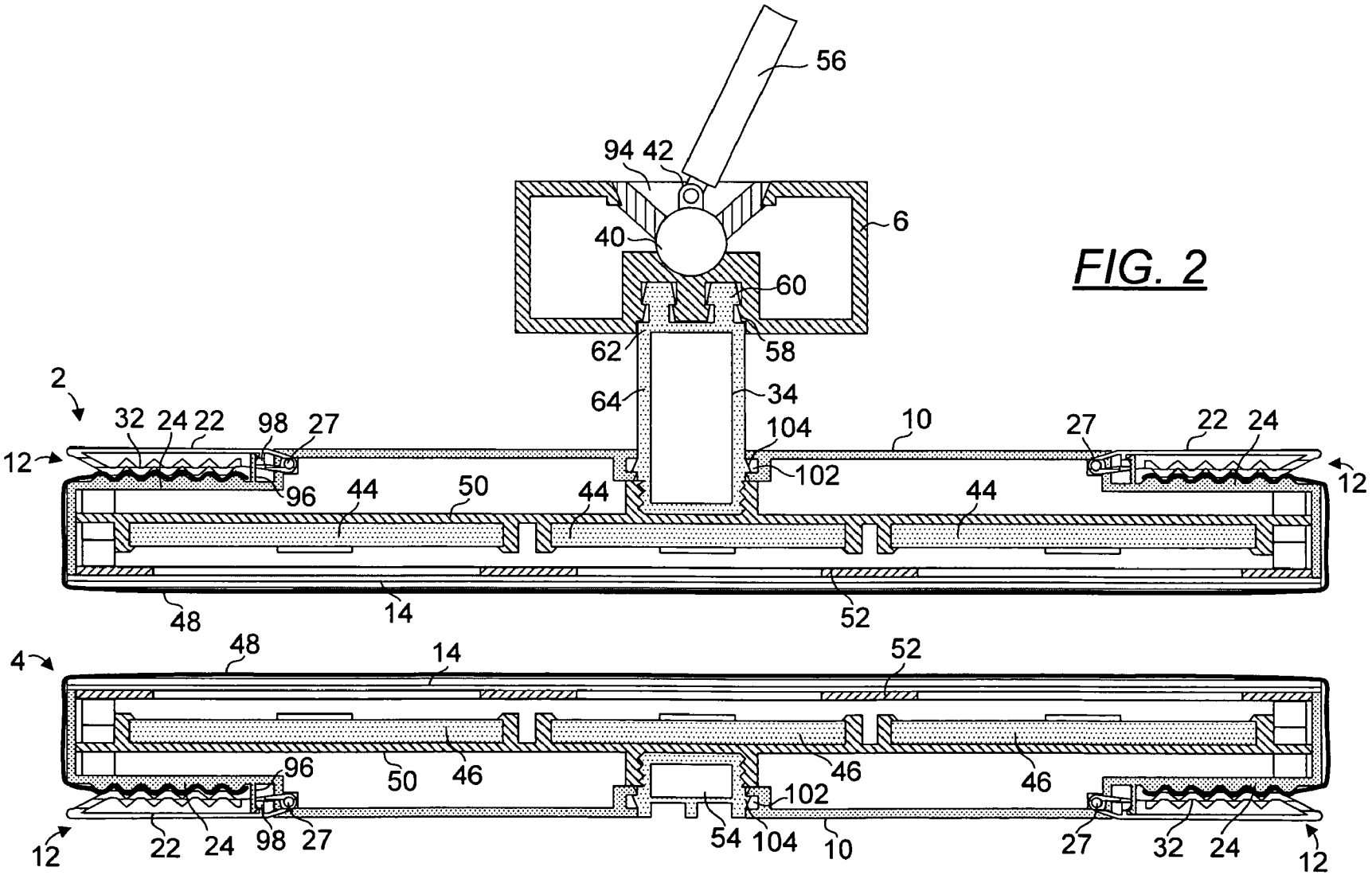
FIG. 2 is a sectional view of a window cleaning assembly depicted in FIG. 1 taken along A-A.

In accordance with the present invention, and referring to FIGS. 1 and 2, there is provided a variable strength magnetic window cleaning device 100 that is used for cleaning both the inside and outside of windows simultaneously. The variable strength magnetic window cleaning device 100 is comprised of an inside cleaning or master unit 2 and an outside cleaning or slave unit 4, each having rare earth magnets (see 44 and 46 of FIG. 2) beneath a replaceable cleaning surface 48 such that the inside 2 and outside 4 cleaning units mutually attract one another on opposite sides of a window. Two window surfaces, inside and outside, are cleaned by the replaceable cleaning surfaces 48 disposed in contact with the window surface and between the opposing magnets 44, 46.

In one embodiment depicted, a novel variable strength magnetic window cleaning device comprises a master unit 2 and a slave unit 4. The master unit 2 comprises a housing 10 affixed to a magnet plate 50 (see FIGS. 2 and 5) having at least one rare earth magnet 44; at least one attachment member 12 configured to secure a replaceable cleaning surface 48 about an engagement surface 14; and a handle 6. The slave unit 4 comprises a housing 10 with a thickness of less than one inch affixed to a magnet plate 50 having at least one rare earth magnet 46 of opposing polarity to the mating rare earth magnet 44 in the master unit 2 or a magnetically attractable material; and at least one attachment member 12 configured to secure a replaceable cleaning surface 48 about an engagement surface 14 (see FIGS. 1, 2 and 3). In one aspect, the master 2 and slave 4 units further comprise an adjusting member 34, and a cover plate 52 (see FIGS. 2 and 4). In one aspect (not depicted), a scraper is provided.

In other embodiments (such as for example, the embodiments depicted in FIGS. 10 and 25), the separate magnet plate component 50 is eliminated and the rare earth magnets 44,46 are operably affixed directly to the master unit 2 and/or slave unit 4 respectively. In embodiments where the magnet position is adjustable, the use of a magnet plate 50 is preferred.

In one aspect of this embodiment, some or all of the rare earth magnets in the slave unit 4 are replaced with a magnetically attractable material such as a metal or metal alloy. This may offer a cost efficiency for the manufacturer without compromising functionality of the device.

The benefits of the present invention include reducing the amount of time and effort it takes to clean windows, particularly storm windows and other common residential windows. The greatest benefit of this invention is that one can safely clean the outside window panes without going outside. This is particularly true for storm windows where they must be removed from their track to be effectively cleaned due to the confined space between the window pane and storm window. There is no longer a need to hire a professional window cleaner to clean the outside panes or storm windows on residential properties. One no longer needs to risk his safety by climbing a ladder or using a power-washer to do the job of cleaning outside window panes or storm windows.

Currently, it is common practice to clean windows using a liquid cleaning agent applied with a cloth, brush, sponge or other means. In most cases, this cleaning step must be followed by a drying step by use of a squeegee, dry cloth, or paper towel. These steps require buckets for the liquid detergents, a ladder or extension handle for non ground level windows, sponges, squeegees or drying cloths as well as some skill and experience to perform adequately. The present invention allows a user to use disposable or re-usable window cleaning wipes, and for cleaning in a more natural circular motion as opposed to the back and forth motion required for squeegee style devices. This eliminates the need for buckets, separate cleaners, and drying paraphernalia. It reduces the number of steps and additional time of such multi-step processes.

Figure 5:
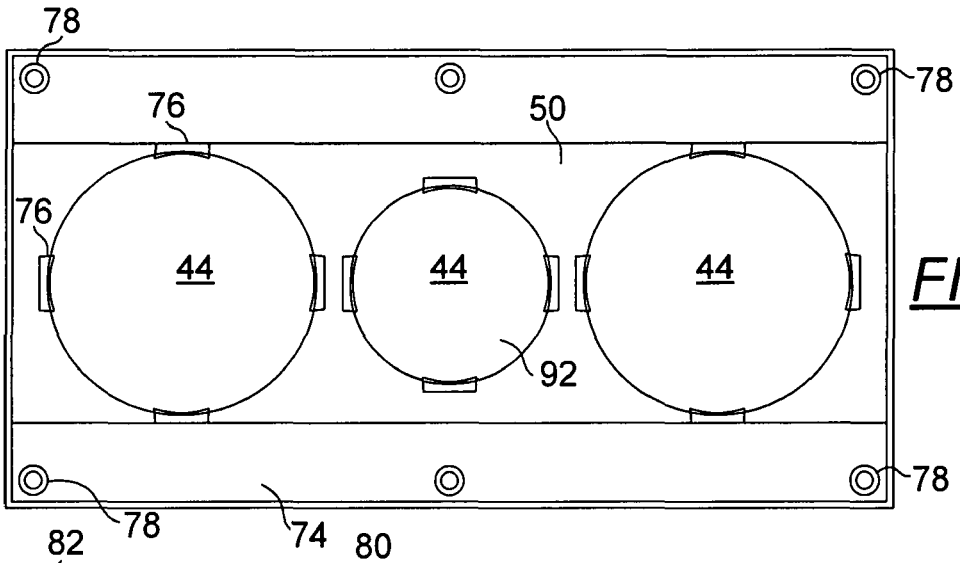
FIG. 5 is a plan bottom view of a magnet plate.
Figure 4:
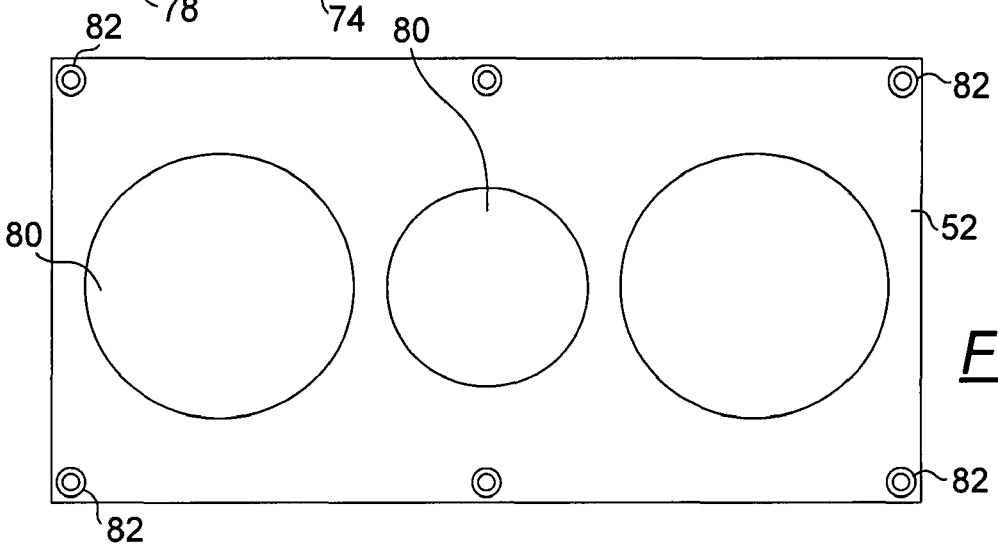
FIG. 4 is a plan view of a cover plate.
Figure 3:
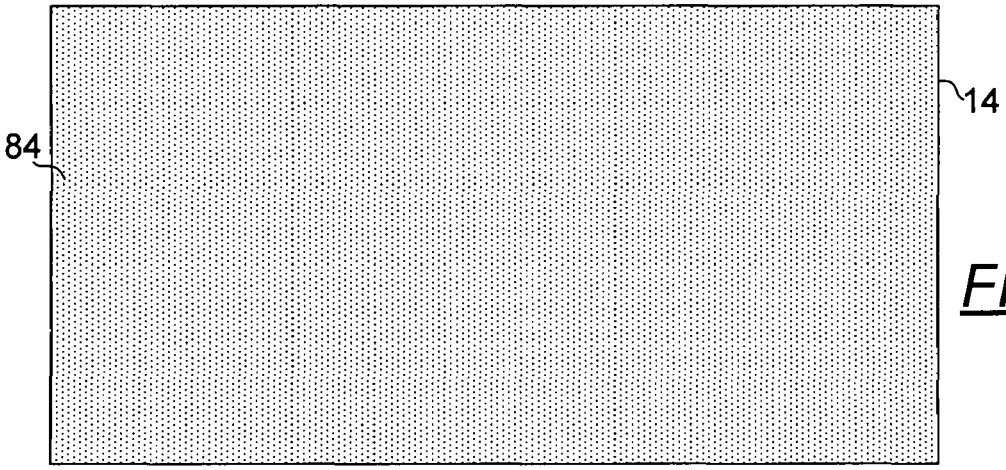
FIG. 3 is a plan view of an engagement surface.

FIG. 1 depicts a perspective view of the variable strength magnetic window cleaning device 100. FIG. 2 is a sectional view of a variable strength magnetic window cleaning device along A-A of FIG. 1. FIG. 3 is a plan view of the engagement surface of a variable strength magnetic window cleaning device. FIG. 4 is a plan view of a cover plate. FIG. 5 is a plan bottom view of a magnet plate.

Referring to FIGS. 1 and 2, the variable strength magnetic window cleaning device 100 comprises a master 2 and a slave 4 unit. The primary difference between the two units 2, 4 is the absence of a handle 6 on the slave unit 4 and the limited thickness of the slave unit 4. This absence of a second handle on the slave unit 4 and its narrow thickness of less than one inch enables the slave unit 4 to be disposed in a narrow confined space such as between a double hung window and a storm window. Referring to FIG. 2, the slave unit 4 has a counter bore screw head style adjusting mechanism 54 in lieu of handle-style adjusting mechanism 34 that protrudes from the housing 10 (see FIGS. 2 and 7).

Preferably, the slave unit 4 comprises a thickness 8 (FIG. 1) of from about ⅛ inch to about one inch, preferably from about ¼ to about ¾ inch.

Figure 9:
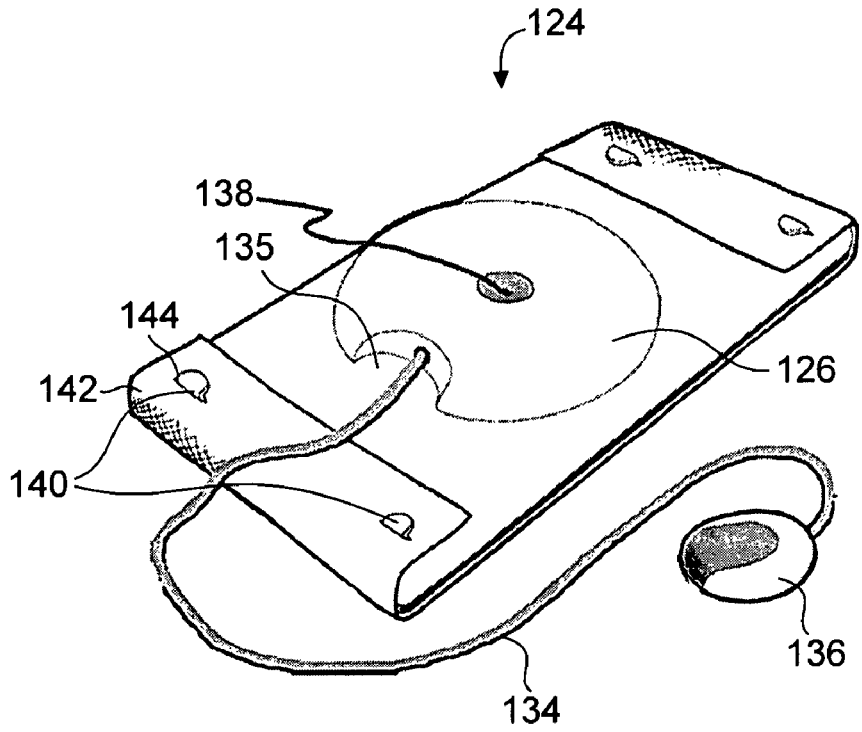
FIG. 9 is a perspective view of an alternate embodiment of a slave unit of a window cleaning assembly.
Figure 10:
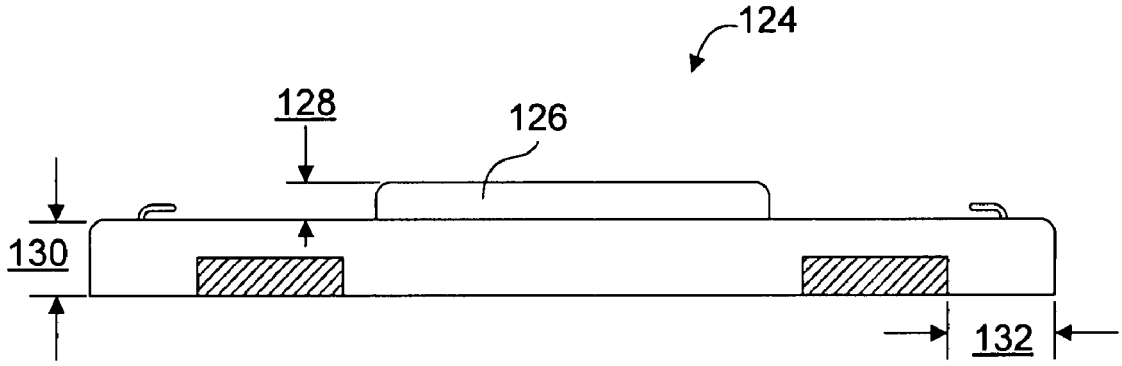
FIG. 10 is a sectional view of the slave unit depicted in FIG. 9.
Figure 11:
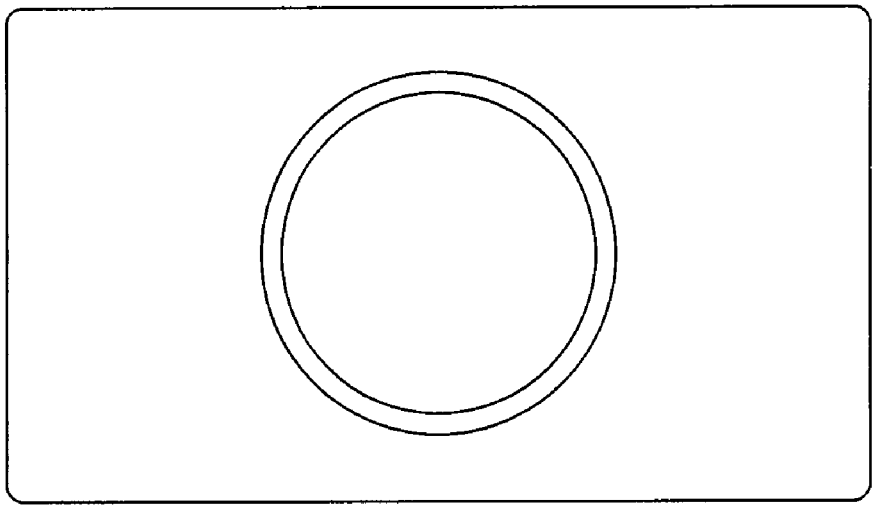
FIG. 11 is a top plan view of the slave unit depicted in FIG. 9.
Figure 12:
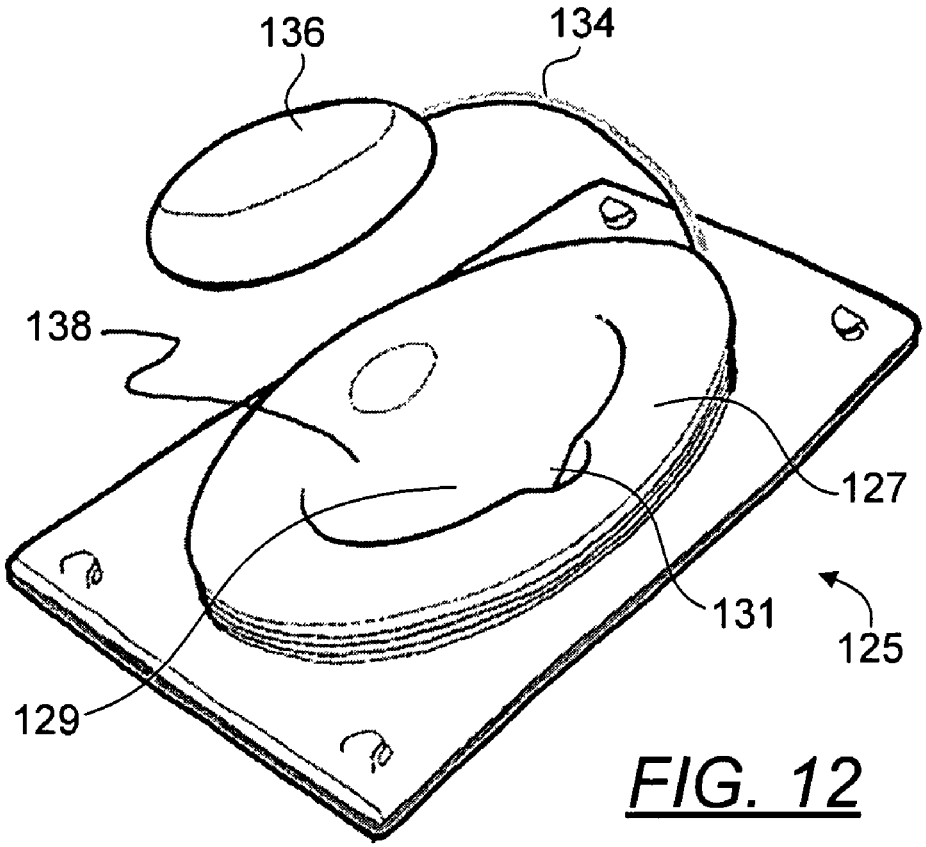
FIG. 12 is a perspective view of an alternate embodiment of the slave unit.

In one embodiment depicted in FIGS. 9-11 as well as the embodiment depicted in FIG. 12, the slave unit 124, 125 has a minimally protruding portion of the housing 126, 127. Referring to FIG. 10, this protruding portion of the housing 126 preferably has a depth 128 of less than ¼ inch such that the profile of the entire unit 124 has a depth (130 and 128) of less than one inch and most preferably, less than ¾ inch. This protruding portion of the housing provides ample space for an adjusting mechanism, safety cord or other desired feature of the slave unit.

Optionally and additionally, a safety cord 134 is disposed on the slave unit 124, 125. One embodiment is depicted in FIGS. 9-11 and an alternate embodiment is depicted in FIG. 12. In the embodiment depicted in FIGS. 9-11, a retractable safety catch 138 is disposed within protruding portion 126 to wrap and stow the cord 134. One end of the cord 134 is affixed to the safety catch 138 and the opposing end of the cord is affixed to a suction cup 136. The suction cup 136 is detachably affixed to a window (or the surrounding structure) when the slave unit 124 is in use and is stored in semicircular notch 135 of the protrusion of the housing (safety catch). In the embodiment depicted in FIG. 12, one end of the cord 134 is affixed to the protrusion 127 of the housing and the opposing end of the cord is affixed to a suction cup 136. The suction cup 136 is stored in circular recess 129 and the cord 134 is wrapped around the periphery of the circular protrusion when not in use. Finger notch 131 in the form of a semicircular recess facilitates the removal of the suction cup 136 therefrom so it may be detachably affixed to a window (or the surrounding structure). This serves as both a convenience and a safety feature. Should the slave unit 124, 125 dislodge from the outside window during use, the slave unit 124, 125 may be retrieved easily by the user. Additionally, the slave unit 124, 125 is prevented from falling toward the ground and injuring person or property unintentionally.

Figure 21:
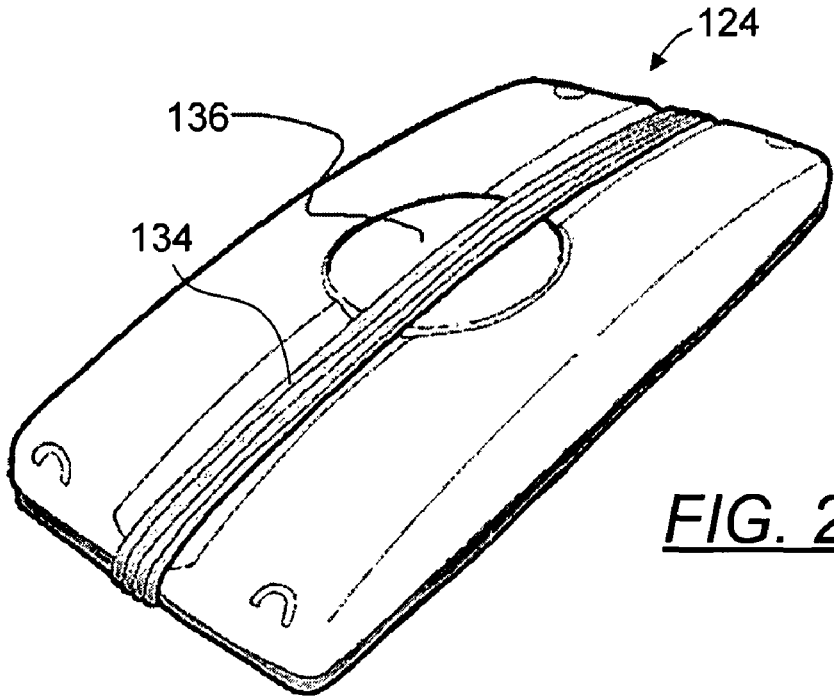
FIG. 21 is a perspective view of an alternate embodiment of a slave unit.

Yet another embodiment of a safety cord 134 is depicted in FIG. 21. One end of the cord 134 is affixed to the slave unit housing and the opposing end of the cord is affixed to a suction cup 136. The suction cup 136 is attached to a window (or the surrounding structure) when the slave unit 124 is in use and stored in a recess formed in the housing when not in use. As depicted, the cord 134 may be wrapped around the slave unit with the suction cup 136 and disposed on the periphery of the housing, or if provided, one or more recesses of the housing for storage. While the embodiment depicted shows the recess for the cord 134 in a longitudinal configuration and the recess for the suction cup as a rounded depression in the central portion of the housing, it is not to be so limited.

Referring to FIGS. 1 and 2, the master unit 2 comprises a housing 10, at least one rare earth magnet (see 44 of FIG. 2), at least one attachment member 12, an engagement surface 14 and a handle 6. The rare earth magnets 44 are recessed and secured below the engagement surface 14 on a magnet plate 50 (see FIG. 5). A cover plate 52 (see FIGS. 2 and 4) is optionally and preferably coupled to the magnet plate 50 to further secure the rare earth magnets 44 on the magnet plate 50. In the embodiment depicted, three rare earth magnets 44 are incorporated in the master unit 2. In a preferred embodiment, magnet plate 50 comprises a plastic body having at least one rare earth magnet 44, 46 affixed thereto and a means for securing the plastic body to an adjusting member 34, housing 10 and/or cover plate 52. Preferably, the housing 10, adjusting member 34 and cover plate 52 are also formed substantially of plastic or other polymeric material.

The attachment member 12 secures a replaceable cleaning surface 48 (see FIG. 2) about the engagement surface 14 of the master unit 2. Preferably, the attachment member 12 is disposed on the top side 16 (FIG. 1) of the master unit 2 such that the replaceable cleaning surface 48 stretches around the transverse sides 18, 20 (FIG. 1) of the master unit 2 when mounted for use (as depicted in FIG. 2). The attachment member 12 secures the replaceable cleaning surface 48 across the engagement surface 14 to prevent "binding" or "bunching" during use.

In one aspect depicted in FIGS. 1 and 2, the attachment member 12 comprises a clamp. FIGS. 1 and 2 depict the clamp 12 in its closed position. The clamp 12 is formed by an upper clamp jaw 22 and a lower clamp jaw 24. The upper clamp jaw is hingeably 27 affixed to the housing 10, allowing the upper clamp jaw 22 to selectively open and close. Optionally and additionally, springs may be incorporated in some aspects of the clamp 12. A replaceable cleaning surface 48 is secured in place by a clamping force or compression between the upper clamp jaw 22 and the lower clamp jaw 24 when the upper clamp jaw 22 is depressed and in the closed position (reference is made to FIG. 2). Applying a downward force to the upper clamp jaw 22 will dispose it in its closed position. In some aspects, the upper clamp jaw 22 snaps closed. Means of snap engagement are well known in the art and many varieties and configurations may be suitably used without departing from the spirit of the present invention. In the embodiment depicted, a hook 96 is disposed on the lower clamp jaw 24 and a mating hook is disposed on the upper clamp jaw 22.

Referring to FIG. 2, to remove or replace a replaceable cleaning surface 48, the upper clamp jaw 22 is opened by applying a force in an upward direction. The clamping or compression force is thus released and the replaceable cleaning surface 48 is free to move. The user may remove the replaceable cleaning surface 48 for cleaning or disposal. Applying a downward force to the upper clamp jaw 22 will dispose it in its closed position and secure a new or fresh replaceable cleaning surface 48 therein.

In one aspect depicted in FIGS. 1 and 2, the peripheral surfaces 26, 28 of the upper 22 and lower 24 clamp jaws contain grooves, ridges or other textured surfaces 32 to create friction and prevent movement of the replaceable cleaning surface 48 in a lateral direction 30 (FIG. 1) when the clamp 12 is in its closed position. Mating teeth like structures may also be used to enhance the grip. This textured surface 32 may be integrally formed into the material of the upper 22 and lower 24 clamp jaws or a separate component affixed thereto. In aspects where the textured surface 32 comprises a separate component, it may be affixed by any means known in the art, including adhesive, mechanical fasteners, welding and the like.

Figure 6:
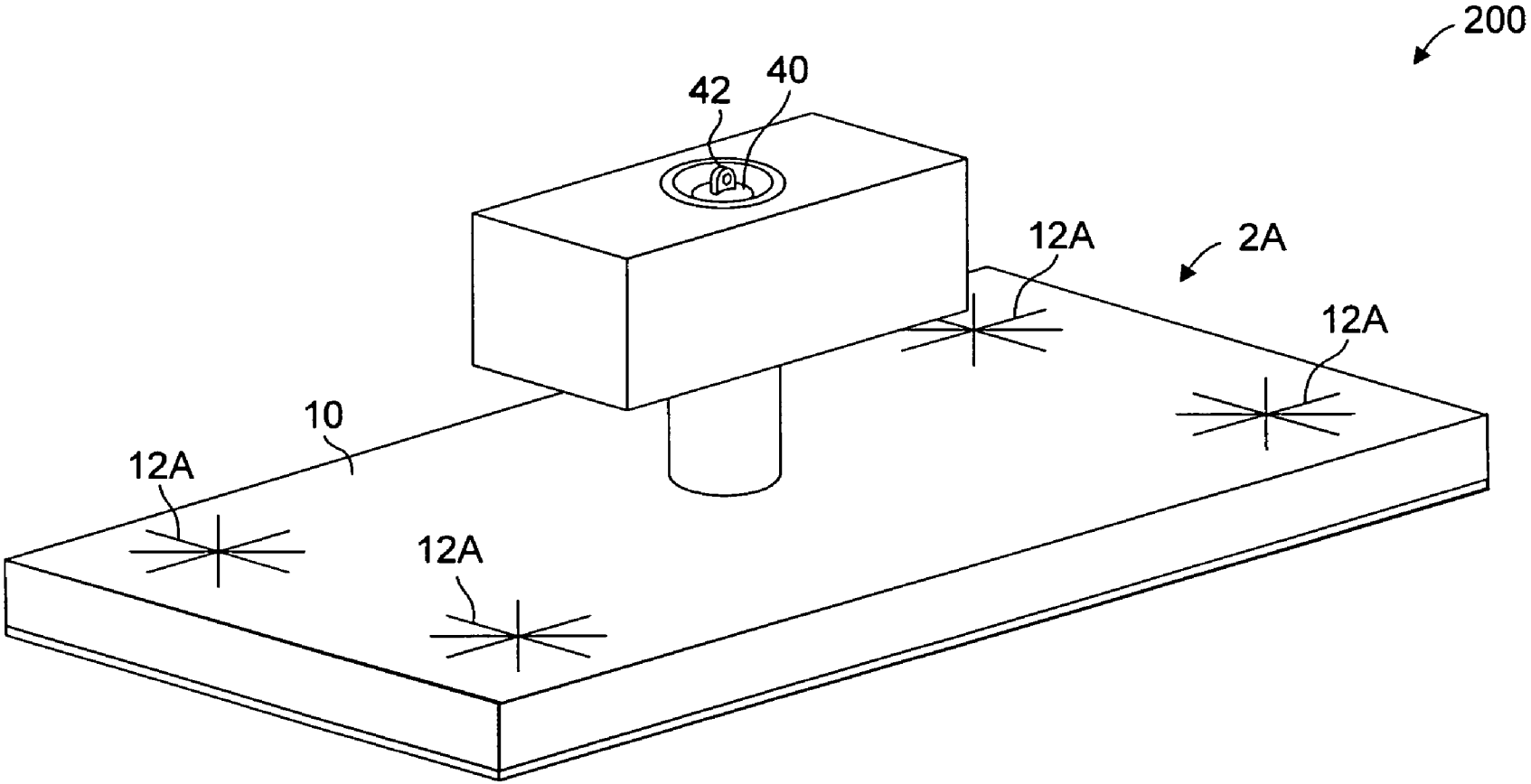
FIG. 6 is an alternate embodiment of a master unit.

FIG. 6 is an alternate embodiment 200 of a master unit 2A. In this aspect, the attachment member 12A comprises a starburst shaped perforation in the housing 10. A replaceable cleaning surface 48 is secured by pushing the four respective corners of the replaceable cleaning surface 48 through the starburst perforation 12A. The starburst perforation creates "teeth" that prevent the replaceable cleaning surface 48 from easily dislodging during use. Applying a pulling force to the replaceable cleaning surface in an opposing direction will, however, remove the replaceable cleaning surface 48 from the attachment member 12A following use.

In another aspect depicted in FIG. 9, the attachment member comprises a plurality of protruding hooks 140 biased inwardly toward the center of the device 124. The replaceable cleaning surface 142 contains mating slits or openings 144 that receive the hooks 140 and removably secure the replaceable cleaning surface 142 about the engagement surface of the slave unit 124.

In another aspect (not depicted), the attachment member 12 comprises a hook and loop member (such as VELCRO) that mates with a hook and loop member on a replaceable cleaning surface.

As will be apparent, other means of attaching a replaceable cleaning surface may be suitably used without departing from the spirit of the invention. Thus, the attachment member may take a variety of styles and configurations to accomplish its intended function of securing the replaceable cleaning surface on the engagement surface of the unit.

Figure 13:
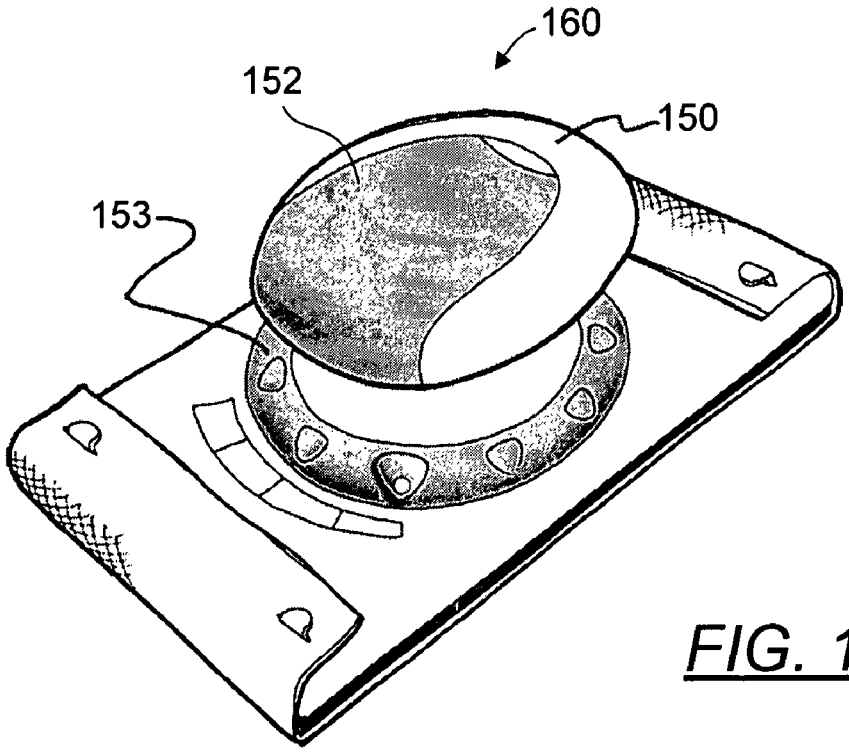
FIG. 13 is a perspective view of an alternate embodiment of a master unit of a window cleaning assembly.
Figure 22:
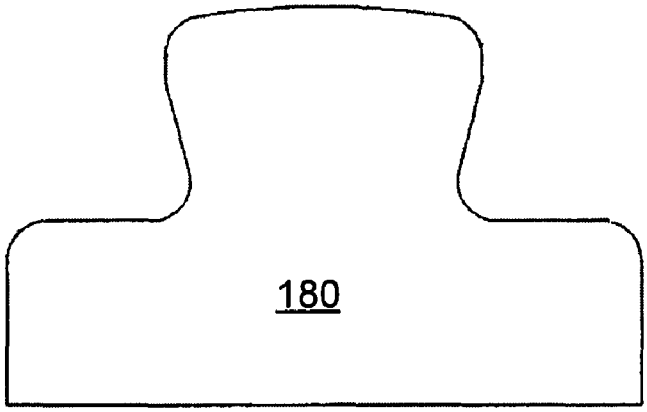
FIG. 22 is a sectional view of an alternate embodiment of a master unit.

As will be apparent to those skilled in the art, the master unit's 2 handle 6 may take many shapes and sizes. Preferably, the handle 6 comprises an ergonomic design that is comfortable for the user. While FIGS. 1 and 2 depict a rectangular shaped handle body, however, a contoured and/or rounded body 150 as depicted in FIG. 13 may be suitably adapted. Other handle 176, 180 designs such as those depicted in FIGS. 19 and 22 may be suitably used with the present invention. Many handle designs are known in the art for a comfortable hand grip by a user.

By way of illustration, but not limitation, one embodiment of a handle 6 depicted in FIGS. 1 and 2 will be described in greater detail. The handle 6 may be manufactured of plastic, rubber, silicone, foam or other similar and obvious materials that would be comfortable to a user of a handle 6 for a device having the purpose of cleaning surfaces. The handle 6 may have an imprint or other identifying indicia. The handle 6 is intended to rest comfortably in the hand of the user without undue difficulty.

Optionally and additionally, the handle 6 may have an extension pole attachment member 42 for attaching an extension pole 56 to the handle 6. In one aspect, the extension pole attachment member (in the embodiment depicted in FIGS. 1, 2 and 6, it takes the form of plastic or metal loop) 42 is disposed in a depression 94 on the upper external peripheral surface of the handle 6 such that the attachment pole loop does not protrude therefrom. The extension pole attachment loop 42 allows a user to affix a broomstick like extension pole 56 to the handle 6 to assist the user in reaching extremely high or low places. The use of the extension pole 56 may also provide a more ergonomic design for the user and assist in reaching hard-to-reach places without bending or straining. In the aspect of this embodiment depicted, a ball joint 40 allows the extension pole 56 and master unit 2 to move relative to one another, providing flexible motion in all directions during use.

Figure 14:
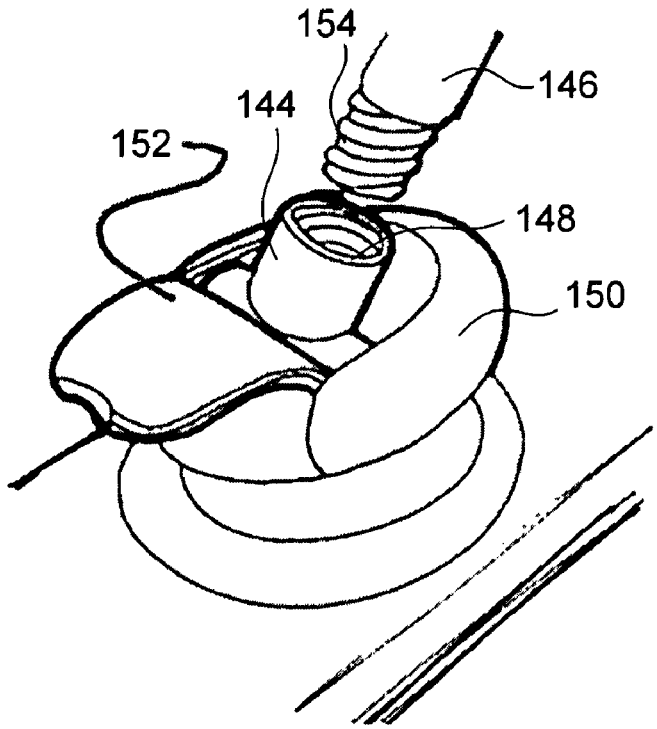
FIG. 14 is a perspective view of one embodiment of the handle of a master unit depicted in FIG. 13.

Yet another embodiment of extension pole 146 attachment member 144 is depicted in FIG. 14. In this embodiment, the handle 150 comprises a flexible flap 152 that may be opened to reveal the cylindrical extension pole attachment 144. The bore of the extension pole attachment 144 has threading 148 adapted to mate with and receive a threaded portion 154 at one end of an extension pole 146.

In one aspect of this embodiment 100 in FIGS. 1 and 2, the master unit 2 further comprises an adjusting member 34. Optimum location of the rare earth magnets 44 via an adjusting mechanism 34, 54 renders the variable strength magnetic window cleaning device 100 cost effective and readily marketable since only one version need be manufactured to be used with many window thicknesses and configurations. The use of an adjusting member 34 (and 54 on the slave unit 4) to bring opposing rare earth magnets 44 (and 46 on the slave unit) closer or further apart enables the variable strength magnetic window cleaning device 100 to be used on both single pane and double pane windows. The adjusting member 34 (and 54 on the slave unit 4) allows the user to adjust the distance of one of more of the rare earth magnets 44 (and 46 on the slave unit) from the engagement surface 14. As will be apparent to one skilled in the art, placement of the rare earth magnets 44, 46 is important to maintain sufficient magnetism between both inside (master) 2 and outside (slave) 4 cleaning units to effectively clean the window surfaces.

As will be apparent, many means of adjusting the distance between the rare earth magnets 44, 46 and the engagement surface 14 may be suitably used without departing from the spirit of the invention. By way of illustration, but not limitation, one embodiment of an adjusting member 34 depicted in FIGS. 1 and 2 will be described in greater detail.

Figure 8:
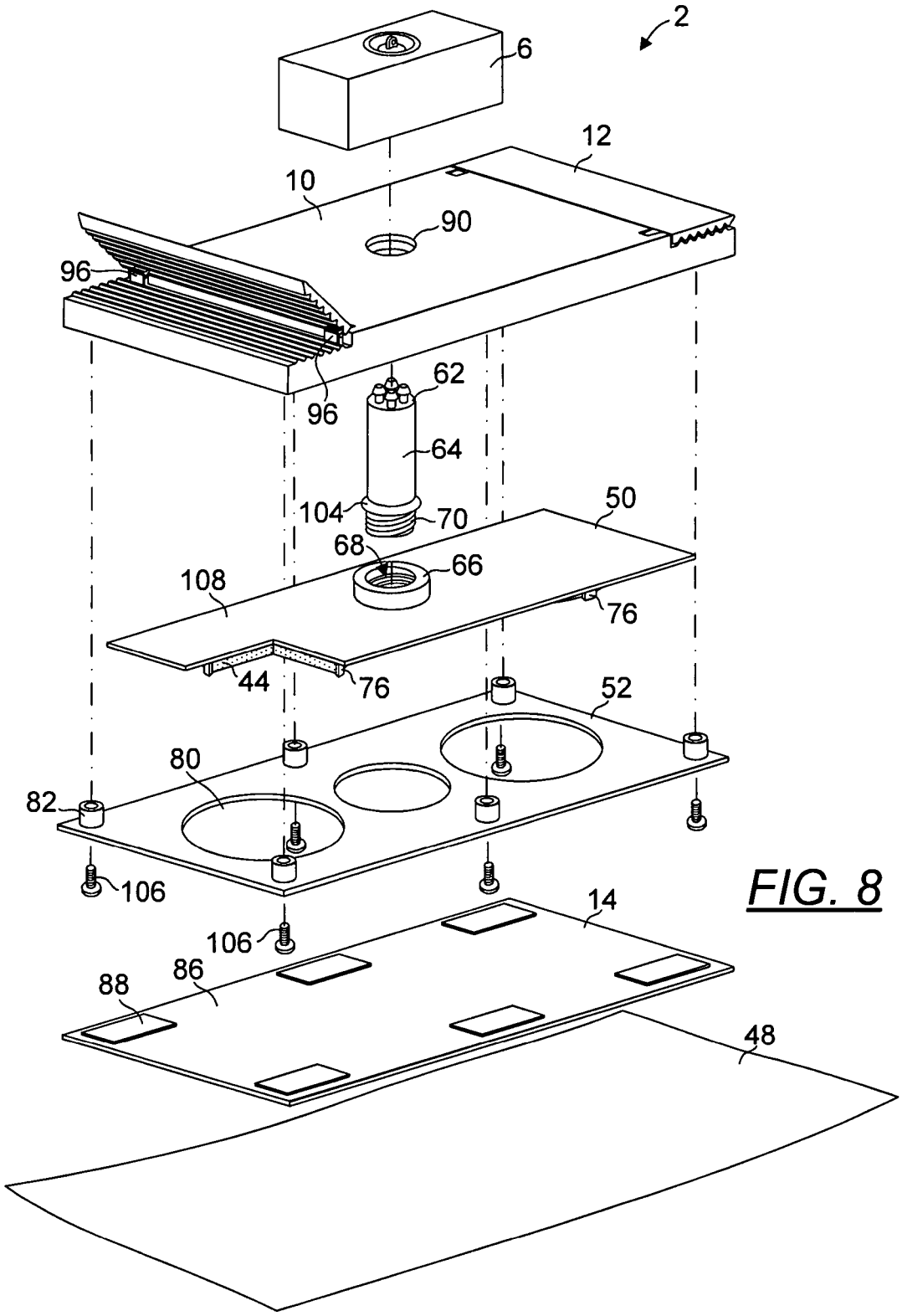
FIG. 8 is an exploded view of the master unit of FIG. 1.

In one embodiment, the adjusting member 34 comprises a jack screw. Referring to FIGS. 1 and 8, the handle 6 is fixedly connected to the adjusting member's 34 body such that twisting the handle 6 causes the jack screw body 64 to rotate. The handle 6 has a plurality of male (recessed) channels 58 for receiving a plurality of mating female prongs 60 protruding from the top portion 62 of the jack screw body 64. A compression fit secures the handle 6 to the jack screw body 64 as the female prongs 60 are inserted into the male recessed channels 58. The jack screw body 64 is affixed to the housing 10 by inserting it through aperture 90 (from its underside) until protruding flange 104 is disposed and hooked in catch 102. In one aspect, the adjusting member further comprises a detent (not shown) that prevents the jack screw body 64 from rotating unintentionally during use.

FIG. 8 is an exploded view of the master unit of FIG. 1. On the top side 108 of a magnet plate 50 is a protruding flange 66 in communication with threaded channel 68 sized and configured to receive the threaded lower portion 70 of the jack screw body 64. The magnet plate 50 does not rotate with respect to the jack screw body 64. When the jack screw body 64 is rotated in a clockwise direction, threading on the lower portion 70 of the jack screw body 64 causes a magnet plate 50 to lower, disposing the rare earth magnets 44 at a greater distance from the handle 6 (thus, closer to the engagement surface 14). Inversely, rotating the jack screw body 64 in a counterclockwise direction causes the magnet plate 50 to rise, disposing the rare earth magnets 44 at a greater distance from the engagement surface 14.

In some aspects, the handle forms at least a portion of the adjusting mechanism. For example, it may form the portion the user contacts to effect the adjustment of the rare earth magnets. As another example, it may also form the outer housing for the adjusting mechanism's component parts.

Figure 15:
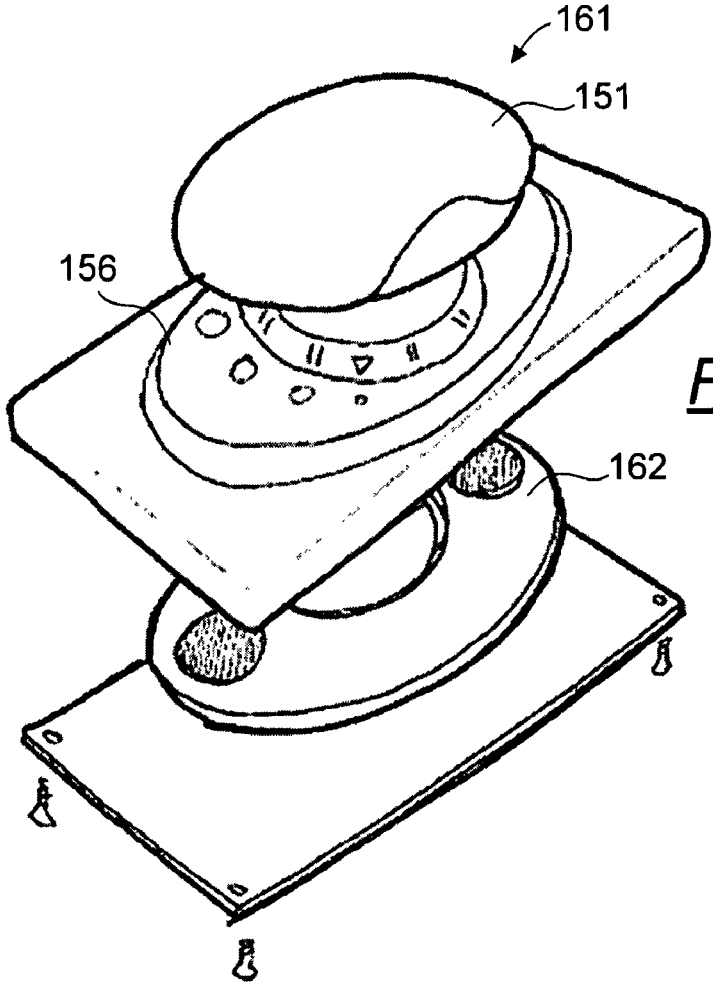
FIG. 15 is an exploded view of a master unit depicted in FIG. 13.
Figure 16:
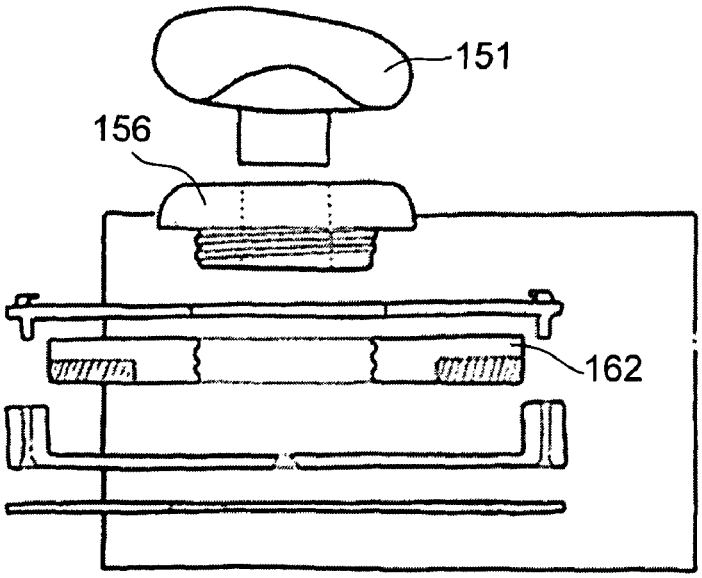
FIG. 16 is an exploded sectional view of a master unit.

Other means of adjusting the distance between the rare earth magnets and the engagement surface is depicted in FIGS. 13 and 15. FIG. 14 is another view of the embodiments 160, 161 in FIG. 13. FIG. 16 depicts yet another variation. In these embodiments, 160, 161 the handle 150, 151 is fixed and a dial 153, 156 is used to adjust the magnet plate 162 (see FIG. 16) up and down. In some aspects of this embodiment, the handle 150 is fixed to and turns with the dial 156.

In an embodiment of the master unit 160 depicted in FIG. 15, the magnet plate 162 has an ovular shape. This smaller magnet plate 162 reduces the overall weight of the master unit 161, which in turn reduces the size of the rare earth magnet required and the cost of manufacturing the device.

Figure 17:
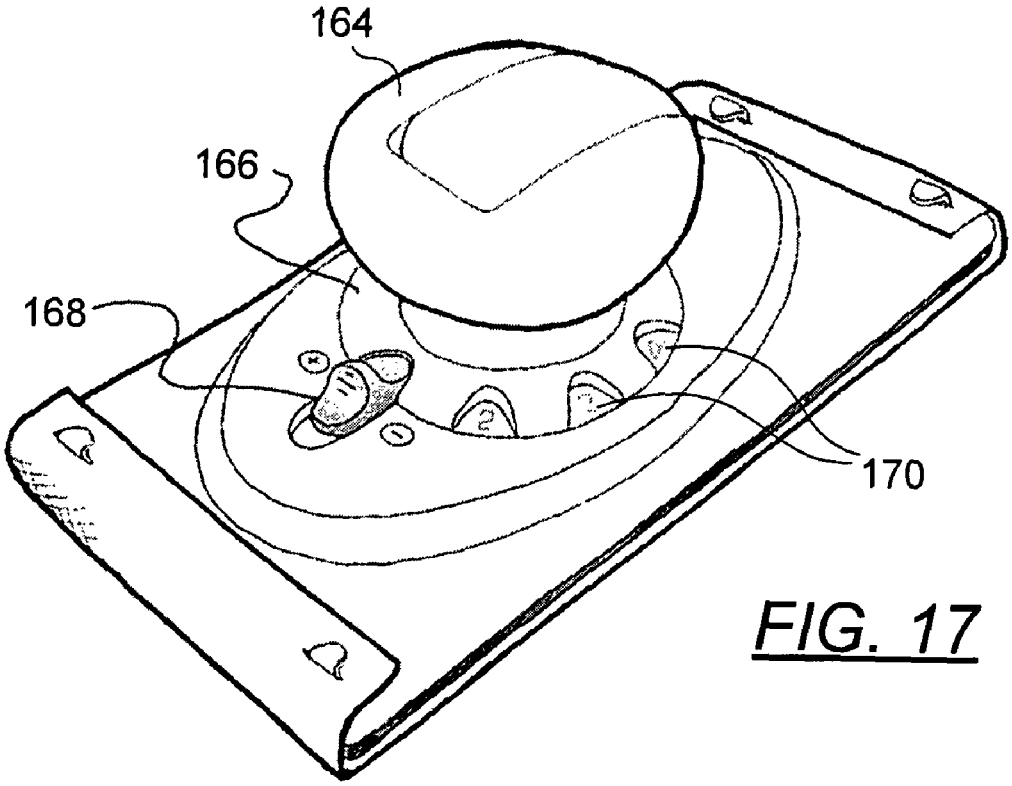
FIG. 17 is a perspective view of an alternate embodiment of a master unit.
Figure 18:
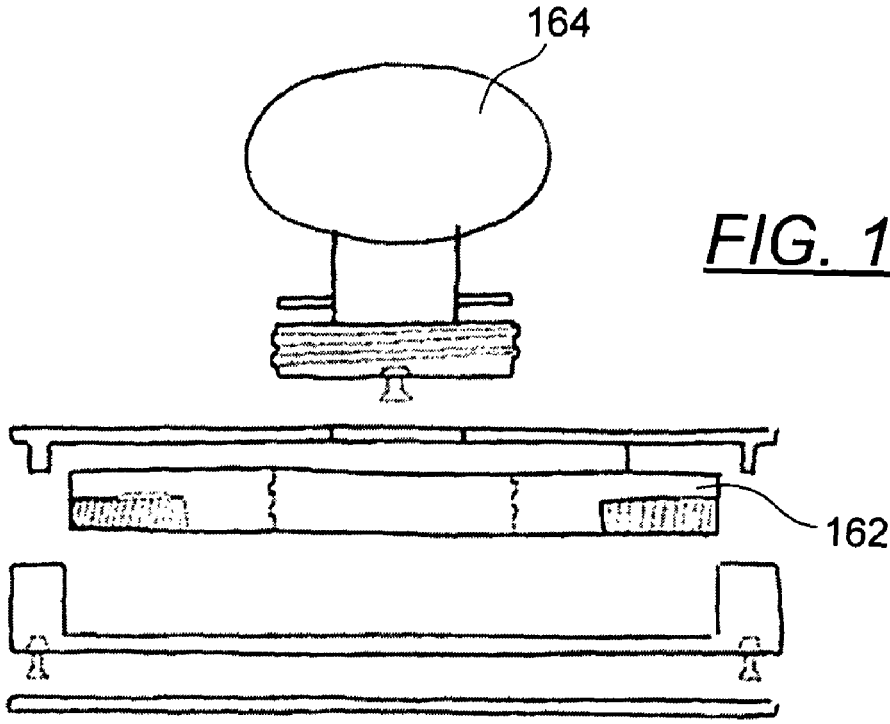
FIG. 18 is an exploded sectional view of a master unit depicted in FIG. 17.

Yet another means of adjusting the distance between the rare earth magnets and the engagement surface is depicted in FIGS. 17 and 18. In this embodiment, the handle 164 twists its dial 166 to adjust the magnet plate 162 up and down. A plurality of detents 170 are disposed radially around the dial 166 and receive spring loaded lock out switch 168 to prevent further rotation of the dial 166 and thereby secure the magnet plate 162 at the desired height.

Figure 19:
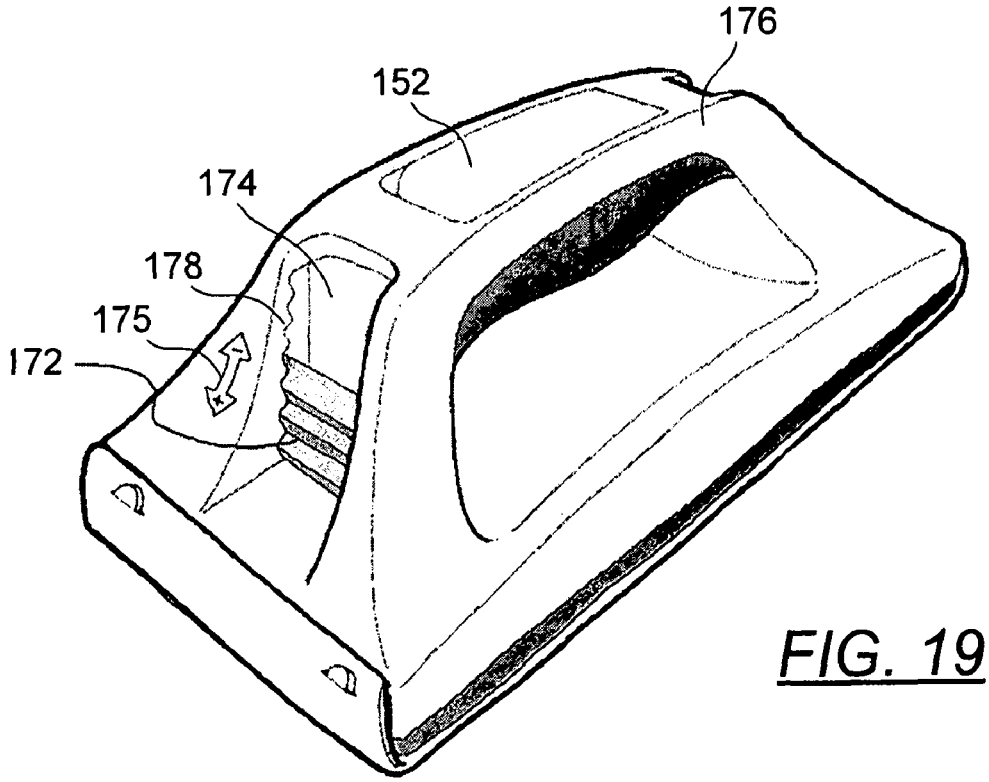
FIG. 19 is a perspective view of an alternate embodiment of a master unit.
Figure 20:
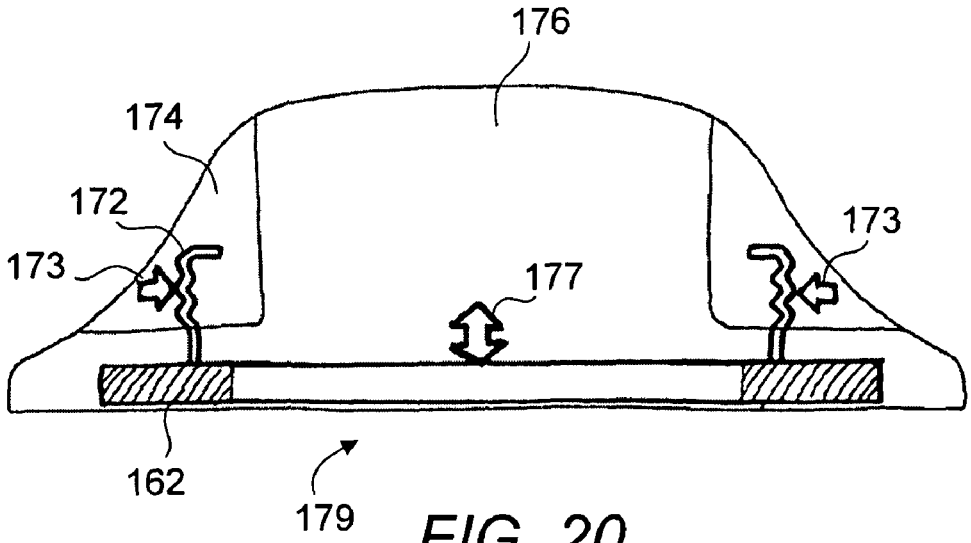
FIG. 20 is a sectional view of a master unit depicted in FIG. 19.

FIGS. 19 and 20 depict another means of adjusting the distance between the rare earth magnets and the engagement surface. In this embodiment, the handle 176 has an opening 174 that receives a leaf spring having a detent clip 172 to adjust the magnet plate 162 up and down. A plurality of ridged detents 178 are disposed along the periphery of the opening 174 and receive the leaf spring 172 to secure the magnet plate 162 at the desired height via the detent clips. The leaf springs 172 are operably connected to the magnet plate 162 and/or the rare earth magnets and/or the magnetically attractable material. To adjust the magnetic strength, a user pushes the leaf spring inwardly 173 toward the center of the unit to disengage the detent clips from the ridged detents 178 and then pushes the leaf spring upwardly or downwardly 175 to raise or lower 177 the magnet plate 162 with respect to the engagement surface 179. When the user releases the leaf spring 172, it returns to its resting position and the detent clips rest in the ridged indents 178 to securely hold the magnet plate 162 at the desired height.

Referring to FIG. 8, the housing 10 of the master unit 2 has a centrally disposed threaded through hole 90, adapted and configured for coupling the handle 6 to the jack screw body 64. (Similar configurations are used for the embodiments depicted in FIGS. 16 and 18 for securing the magnet plate to the jack screw component.)

Referring to FIGS. 2, 3, 4, 5 and 8, the master unit 2 comprises a magnet plate 50 and a cover plate 52 affixed to the housing 10. As will be apparent, many means of securing the housing 10 and cover plate 52 to the magnet plate 50 may be suitably used with the present invention without departing from the spirit of the invention. By way of illustration, but not limitation, the housing 10 and/or cover plate 52 may be secured to the magnet plate 50 by an adjusting mechanism or adhesive materials, welding, compression, mechanical fasteners and the like.

In the embodiment depicted in FIGS. 2, 3, 4, 5 and 8, the magnet plate 50 comprises a rectangular plastic plate. It is not so limited to such shape. For example, it may also be ovular as depicted in FIG. 15. On the bottom side 74 (see FIG. 5) are disposed a plurality of mechanical fasteners, brackets, 76 for securing one or more rare earth magnets 44. As will be apparent, many means of securing the rare earth magnets 44 to the magnet plate 50 may be suitably used without departing from the spirit of the invention. By way of illustration, but not limitation, the rare earth magnets 44 may be secured to the magnet plate 50 by adhesive materials, welding, compression, mechanical fasteners (e.g. screws, push pins, clips or brackets) and the like.

In the embodiment depicted in FIGS. 2, 5 and 8, the housing 10 50 also has a plurality of apertures 78 (see FIG. 8) for affixing the housing 10 to the cover plate 52 (see FIG. 4). The apertures 78 may be threaded or nonthreaded. These apertures 78 may receive a mechanical fastener such as a screw, peg, prong, nail, or a compression fit component.

In the embodiment depicted in FIGS. 2, 4 and 8, the cover plate 52 comprises a rectangular plastic plate with openings 80 to expose the rare earth magnets 44 through the cover plate 52. The cover plate 52 serves to protect and further secure the rare earth magnets 44 in the master unit 2. In the embodiment depicted, the cover plate 52 also has a plurality of apertures or protrusions 82 for affixing the cover plate 52 to the housing 10, and thereby securing magnet plate 50 there between. The apertures or protrusions 82 may be threaded or nonthreaded. These apertures 82 may receive, mate with, or comprise a mechanical fastener such as a screw or a compression fit component. In one aspect depicted (e.g., FIG. 8), a screw 106 is inserted through protrusion 82 and into a mating aperture (not visible) on the underside of the housing 10.

Rare earth magnets 44, 46 are preferably used with the present invention. Rare earth magnets 44, 46 are strong, permanent magnets made from alloys of rare earth elements and include, for example, Neodymium Iron Boron (Neo) and Samarium Cobalt magnets. By way of illustration, but not limitation, NdFeB or NIB magnets may be used. They are composed primarily of Neodymium (Nd), Iron (Fe) and Boron (B). In one embodiment, one may suitably use Samarium Cobalt (SmCo) 18, 20, 24 or 26 magnets and/or Neo 27, 27H, 30, 30H or 35 magnets. It is not required that all of the magnets be the same size or variety. It is required, however, that mating or opposing magnets, in the master and slave units respectively, be of opposing polarity such that they attract one another.

By way of further illustration, one may suitably use a rare earth magnet 44, 46 of SmCo with a density of from about 8.2 to about 8.4 g/cm or of Neo with a density of about 7.4 g/cm. By way of illustration, one may suitably use a rare earth magnet 44, 46 with a coercive force Hc of about 8,000 to 10,500 Oersteds. By way of further illustration, one may suitably use a rare earth magnet 44, 46 with an intrinsic coercive force Hc of about 20,000 to 120,000 Oersteds. The rare earth, especially neodymium, magnets 44, 46 may be nickel, epoxy or otherwise coated for protection against corrosion.

These rare earth magnets 44, 46 are preferable because they are substantially stronger than ferrite or alnico magnets, having a magnetic field in excess of 1.2 teslas in comparison with ferrite or ceramic magnets typically exhibiting fields of 50 to 100 milliteslas. NdFeB magnets have incredible strength, easily holding 100-300 times their weight in iron. Since rare earth magnets 44, 46 are much stronger than ferromagnetic magnets, smaller and lighter weight magnets may be used to create the necessary magnetic force required to attract the master 2 and slave 4 units to one another while in use.

In one embodiment, Neodymium is used to take advantage of its moderate price and strong performance. Additionally, Neodymium is less brittle that Samarium Cobalt and it is easier to machine and integrate into assemblies. The use of Neodymium magnets makes the present invention cost effective, convenient to use, lighter weight and manufacturable at a relatively low cost.

In another embodiment, Samarium Cobalt $SmCo_5$ is used to take advantage of its high resistance to demagnetization and corrosion resistance.

Rare earth magnets 44, 46 may be formed in any variety of shapes and sizes that may be configured and adapted to a housing 10 and magnet plate 50 of the present invention. By way of illustration, these shapes may include discs, rods, cubes, plates/blocks, tubes, rings, horseshoes, spheres, dimpled rods, and cubes with holes. In some aspects, an array of rare earth magnets is used as a substitute for one larger magnet.

While not necessary, applicant believes that round shaped magnets (discs, plates, rings and the like) as depicted in FIGS. 2, 5 and 8 provide optimum performance. Applicant also believes superior performance of the rare earth magnets 44, 46 is observed when three rare earth magnets 44, 46 are used in each the master 2 and slave 4 units. Preferably, the three rare earth magnets (and the mating rare earth magnets of the slave unit) are disposed in longitudinal alignment such that there are two peripherally disposed rare earth magnets and one centrally disposed rare earth magnet. Preferably, the centrally disposed magnet 92 (of FIG. 5) is smaller than the peripherally disposed rare earth magnets 44, 46. This configuration has been found to reduce the "chattering" that causes otherwise like devices to lose their magnetic attraction and thus separate, rendering the cleaning device ineffective. It has been determined that the magnets thus disposed, in addition to the textured and/or rubber-like underside on the engagement surface 14 (FIG. 2), enables maximum magnetic attraction reducing the likelihood of separation between master 2 and slave 4 units.

One embodiment depicted in FIGS. 23, 24, 25, 26 and 27 has two rare earth magnets (196, 198 in the slave unit and 218, 220 in the master unit) exerting the opposing polarity (toward the other unit) in each master 204 and slave 194 unit. This embodiment also differs in that the slave unit 194 has two engagement surfaces: a second engagement surface 202 and a third engagement surface 300. Thus, one rare earth magnet 196 (or rare earth magnet array) has a "north" polarity toward the second engagement surface 202 and one rare earth magnet 198 has a "south" polarity toward the second engagement surface 202. The inverse is also true that one rare earth magnet 198 or rare earth magnet array has a "north" polarity toward the third engagement surface 300 and one rare earth magnet 196 has a "south" polarity toward the third engagement surface 300.

Referring again to FIGS. 24, 27A and 27B, the master unit 204 comprises a handle 224, a first engagement surface 222, a first rare earth magnet 218 (or magnet array) and a second rare earth magnet 220 (or magnet array). To effect a "flip and invert" 226 method of variable magnetic strength, the first rare earth magnet 218 and the second rare earth magnet 220 are disposed symmetrically about an X and a Y axis of the first engagement surface 222 (reference is made to FIG. 26 describing the same relationship with respect to the slave unit). The first rare earth magnet 218 has a "north" polarity facing the first engagement surface 222 and the second rare earth magnet 220 has a "south" polarity facing the first engagement surface 222.

Referring to FIGS. 24-27, the slave unit 194 comprises a second engagement surface 202 and a third engagement surface 300, a third rare earth magnet 196 and a fourth rare earth magnet 198. The slave unit 194 has a thickness 234 between the second engagement surface 202 and the third engagement surface 300 of less than about one inch. The third rare earth magnet 196 and the fourth rare earth magnet 198 are disposed symmetrically about an X 210 and a Y axis 212 of the second engagement surface 202. Thus distances 216A, 216 B, 216C, 216D are the same and distances 214A, 214B, 214C, 214D are the same.

The third rare earth magnet 196 has a "north" polarity facing the second engagement surface 202 and the fourth rare earth magnet 198 has a "south" polarity facing the second engagement surface 202 such that the first 218 and second 220 rare earth magnets of the master unit 204 magnetically attract the third 196 and fourth 198 rare earth magnets in the slave unit 194.

The third 196 and fourth 198 rare earth magnets are disposed asymmetrically with respect to the midpoint 236 about the thickness 234 of the slave unit 194 and along a plane parallel with the second 202 and third 300 engagement surfaces. Thus, the third 196 and fourth 198 rare earth magnets are disposed closer to the second engagement surface 202 than the third engagement surface 300.

Figure 23:
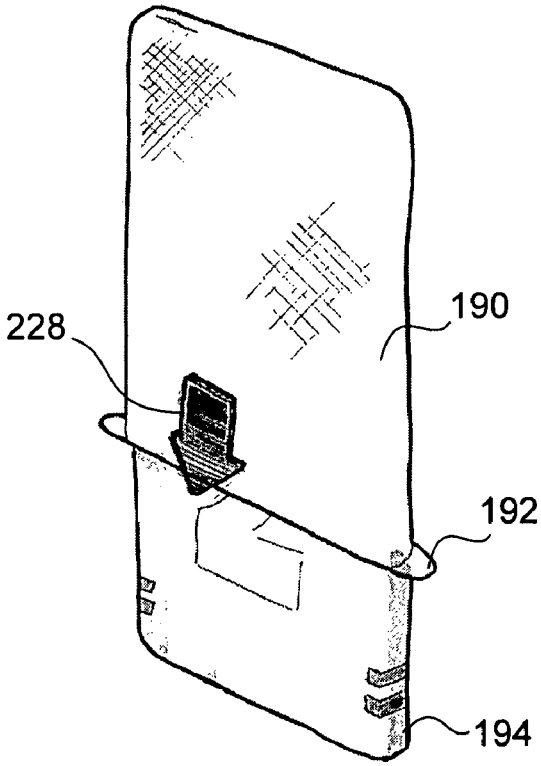
FIG. 23 is a perspective view of an alternate embodiment of a slave unit and one embodiment of a disposable cleaning surface disposed thereon.
Figure 24:
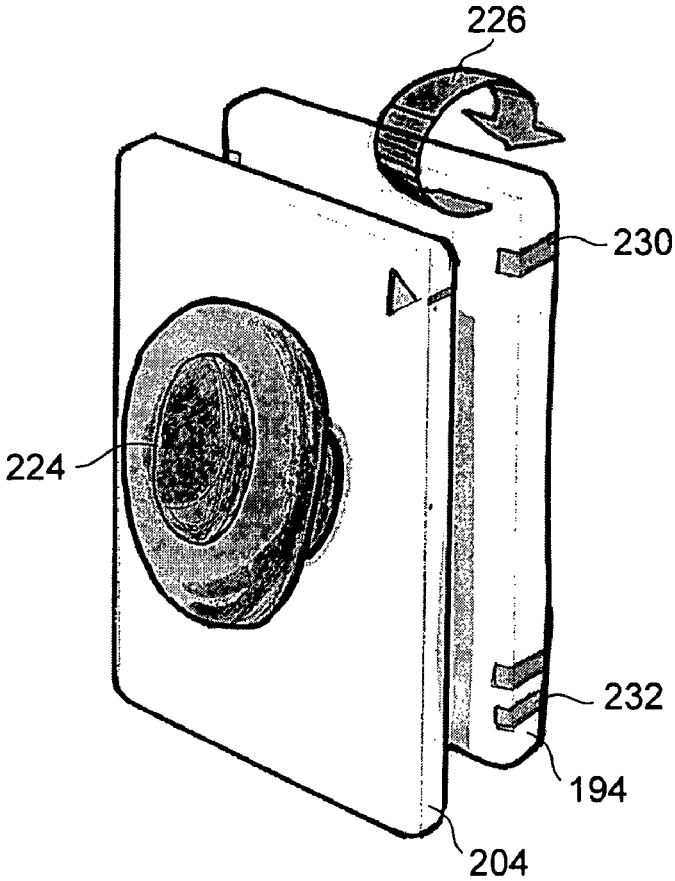
FIG. 24 is a perspective view of an alternate embodiment of a master unit and the slave unit depicted in FIG. 23.
Figure 25:
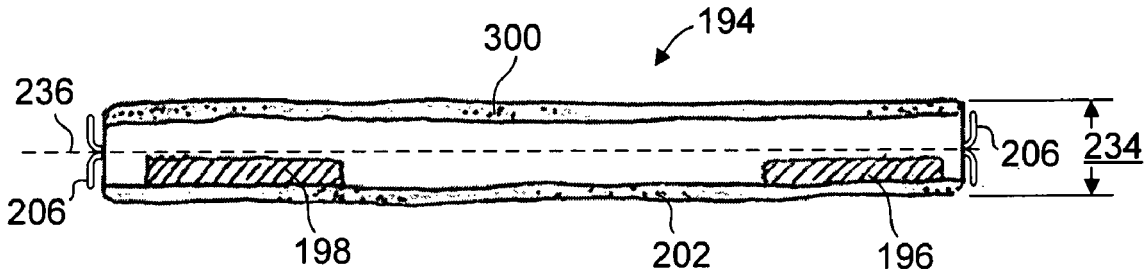
FIG. 25 is a sectional view of the slave unit depicted in FIG. 23.
Figure 26:
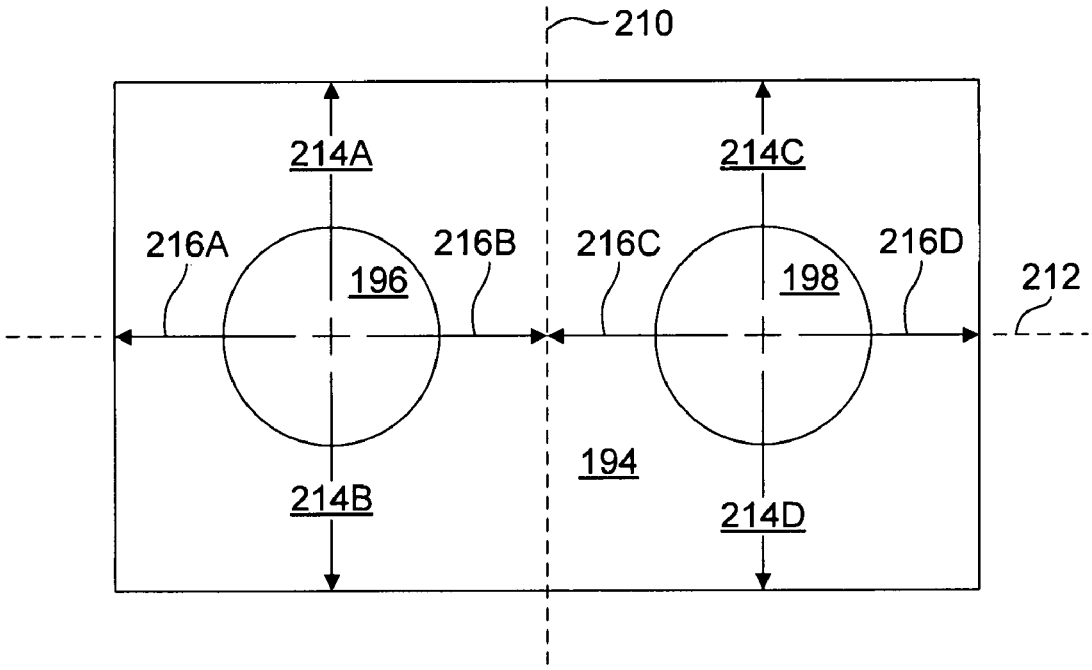
FIG. 26 is a bottom sectional plan view of the slave unit depicted in FIG. 24.
Figure 27A:
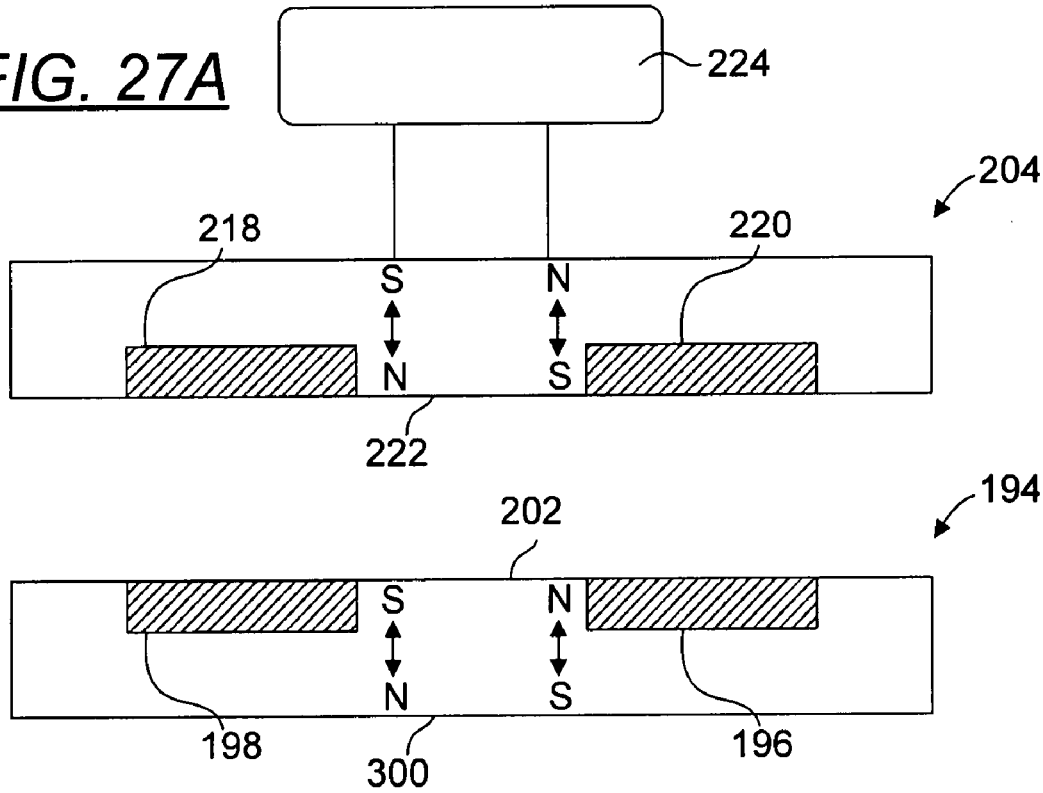
FIGS. 27A and 27B are an orthogonal cross sectional views of the master unit and the slave unit depicted in FIG. 23.
Figure 27B:
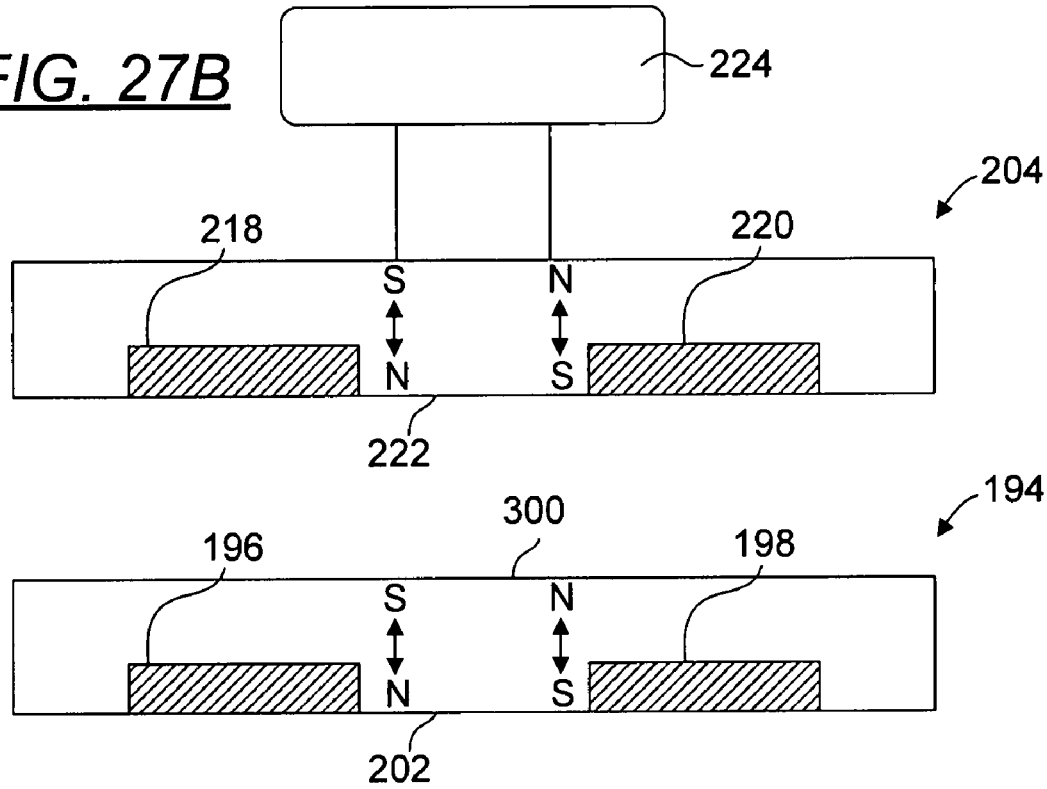

The master unit 204 has a first replaceable cleaning surface (not depicted) situated thereon and in contacting engagement with the first engagement surface 222. As previously described, the master unit 204 has a plurality of attachment members configured to receive and removably the secure the first replaceable cleaning surface thereon. Referring to FIGS. 23 and 24, the slave unit 194 has a second replaceable cleaning surface 190 situated thereon. The second engagement surface 202 and third engagement surface 300 are configured for receiving the second replaceable cleaning surface 190. Referring to FIG. 25, optional attaching members 206 may be disposed along the transverse edges of this dual sided slave unit 194 to enable disposable wipe style replaceable cleaning surfaces to be secured thereto. In the aspect depicted in FIG. 25, a hook style attaching member 206 is provided.

Referring to slave unit 194 in FIG. 25, the opposing polarity rare earth magnets 196, 198 of the slave unit are disposed closer to one side 202. When side 202 is disposed against a double pane window, greater magnetic strength is exerted between magnets 196, 198 of slave unit 194 and magnets 218, 220 of the master unit 204 (see FIG. 24). By flipping and inverting 226 the slave unit 194 such that side 300 is disposed against a single pane window, lesser magnetic strength is exerted between magnets 196, 198 of slave unit 194 and magnets 218, 200 of the master unit 204.

Thus, no moving parts are required for a semi-adjustable magnetic strength. The flip and inversion 226 of the slave unit 194 provides two magnetic strength options for the user. The use of opposing polarity rare earth magnets 196, 198 in each unit 194, 204 and the symmetrical location of the rare earth magnets about the engagement surfaces facilitates this flip and invert 226 method for using this embodiment. This embodiment provides a device that can be used with two different thicknesses of windows (single and double pane) without requiring any mechanical parts in the nature of an adjusting mechanism. This overcomes the limitation of the prior art with a single strength master and slave pair that is either too strong for the window and skips and chatters across the glass during use or too weak for the window such that the slave unit dislodges during use.

Additional benefits of the rare earth magnets 44, 46 include the fact that alternating polarities within a single unit need not be considered (except in the flip and invert embodiment in FIGS. 23-27B) and specific shapes (e.g. horseshoe shaped) of magnets are not required for the variable strength magnetic window cleaning device 100 to function. (Opposing polarity between mating magnetic parts 44, 46 is required to effect magnetic attraction between master 2 and slave 4 units, of course.)

Preferably, the exposed surface area of the rare earth magnets 44, 46 comprises from about 10 to about 80, preferably from about 20 to about 60, percent of the surface area of the peripheral surface of the bottom side 74 of the magnet plate 50.

In one aspect (not depicted), a ferromagnetic material is disposed between the rare earth magnets 44, 46 and the magnet plate 50 to increase the magnetic force exerted by the rare earth magnets 44, 46. This allows for thinner or smaller rare earth magnets 44, 46 to be used without diluting the magnetic force exerted.

In one preferred embodiment, the master unit 2 further comprises a separate engagement surface 14. Alternatively, the cover plate 52 also comprises the engagement surface 14. Preferably, the exterior peripheral surface 84 (FIG. 3) of the engagement surface 14 is textured. This textured surface assists in maintaining the magnetic adhesion between the master 2 and slave 4 units. With a smooth surface, the master 2 and slave 4 units have a tendency to disengage from the window and one another during use. Preferably, a rubber like material, polymeric material or silicone is used for the exterior peripheral surface 84 of the engagement surface 14. In one aspect, a waterproof material or material that is resistant to deterioration from cleaning agents is used. The engagement surface 14 may be formed of such rubber-like polymeric material, or alternatively, a thin layer of such material may be affixed thereto.

Referring to FIG. 8, the interior peripheral surface 86 of the engagement surface 88 has a plurality of adhesive or hook and loop members 88 for affixing the engagement surface 14 to the cover plate 52.

Referring to FIG. 2, in one embodiment, the master unit 2 further comprises a replaceable cleaning surface 48. The replaceable cleaning surface 48 may comprise any number of conventional window cleaning cloths, wipes or pads that wipe and trap debris on its surface. Preferably, the replaceable cleaning surface 48 comprises a disposable cloth or wipe premoistened with a window cleaning solution. The replaceable cleaning surface 48 may also be a paper towel (wet or dry), a microfiber cloth, a multi-purpose cleaning cloth, a window cleaning buffer, a lint free cloth and the like.

The replaceable cleaning surface 190 depicted in FIG. 23 is formed in the shape of a sleeve or a glove style pouch with one open end that envelops the slave unit 194. Pull tabs 192 facilitate easy installation (and removal) of the replaceable cleaning surface 190 over the slave unit 194 as it is pulled in direction 228 (and inverse for removal).

In one embodiment, at least a portion of the replaceable cleaning surface 48 comprises a scrubbing material. The scrubbing material surface may comprise any low friction, semi-abrasive surface that would be useful to remove debris from a window pane without scratching the glass surface. These scrubbing materials include common materials used in kitchen and bathroom cleaning implements, a woven fabric texture, slits, voids, tendrils (e.g., VELCRO hook and loop), perforations, raised ridges, raised bumps, depressions, grooves, combinations thereof, and the like. This textured surface provides friction to assist a user in cleaning and/or scrubbing hard to remove debris from the window surface. The textured surface also provides for smooth gliding by eliminating "stuttering" as the variable strength magnetic window cleaning device 100 traverses across the glass surface.

In one embodiment (not depicted), the housing of the slave unit and/or the master unit further comprise at least one scraping ridge at a location adjacent to the replaceable cleaning surface. This enables a user to scrape debris that is difficult to remove solely with the replaceable cleaning surface (bird feces, dead insects, dried-on food, and the like). This scraping ridge may be integrated with the housing or a removable accessory that is mounted thereto. The scraping ridge is formed of a material that is resilient and does not scratch or damage the window surface during use.

Figure 7:
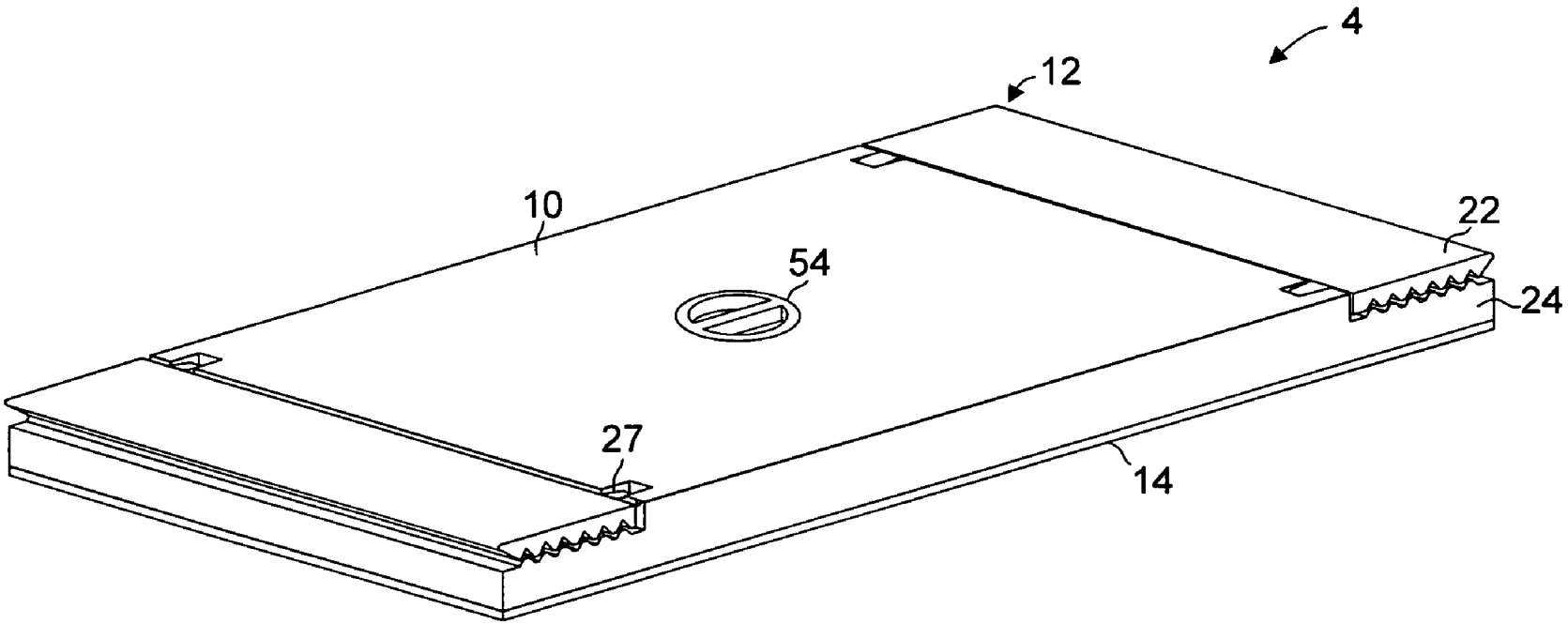
FIG. 7 is a perspective view of a slave unit.

The slave unit 4 of FIG. 7 is substantially the same as depicted and described with respect to the master unit 2 with the exception that there is no handle 6 and the jack screw body 34 does not protrude from the housing 10, that is, it is flush with the peripheral surface of the housing 10. Referring to FIG. 7, the jack screw body of the slave unit 4 comprises a screw head like structure 54. Recessed portions in the top peripheral surface of the slave unit's 4 jack screw body 54 forms a finger grip for rotating the jack screw body 54 to raise and lower the slave unit's 4 magnet plate 50.

As will be apparent, the magnetic components (opposing polarity rare earth magnets) 46 of the slave unit 4 will compare in size, location and strength to their mating magnetic component 44 in the master unit 2 and will be of opposing polarity to effect the magnetic attraction between the master 2 and slave 4 units.

The variable strength magnetic window cleaning device 100 is aesthetically pleasing and has ancillary uses. Although the device's major purpose is to simultaneously clean both the inside and outside panes of windows using the combination of both master 2 and slave 4 units, the device was also designed with the intention of using the master unit 2 as a stand alone device to clean one sided surfaces such as mirrors, chalkboards, or most any other surfaces that require cleaning and would benefit from the use of securing a replaceable cleaning surface 48 to the master unit 2 to better scrub and clean dirty areas. Using the master unit 2 in this way will prevent bunching or binding of the replaceable cleaning surface 48. When the master 2 and/or slave 4 unit are not otherwise in use, they are intended to be used as refrigerator magnets or even as aesthetically pleasing window decoration which are gaining in popularity.

I claim:

1. A variable strength magnetic window cleaning device having, in combination, a master unit and a slave unit magnetically attracted into close proximity wherein the master unit has at least one rare earth magnet operably affixed to a housing thereof, the slave unit has at least one magnetically attractable material operably affixed to a housing thereof, wherein the at least one rare earth magnet of the master unit magnetically attracts to the magnetically attractable material in the slave unit, the master unit and slave unit each have a replaceable cleaning surface situated thereon, the replaceable cleaning surfaces being a disposable wipe premoistened with cleaning solution, the master unit and slave unit each have a plurality of attachment members configured to receive and removably secure replaceable cleaning surfaces thereon, the housing of the master unit further comprises a handle, the housing of the slave unit has a thickness of less than about one inch, and the slave unit further comprises a retractable safety catch.

2. A variable strength magnetic window cleaning device having, in combination, a master unit and a slave unit magnetically attracted into close proximity wherein the master unit and slave unit each have at least one rare earth magnet operably affixed to a housing thereof, wherein the at least one rare earth magnet of the master unit magnetically attracts to the at least one mating rare earth magnet in the slave unit, the master unit and slave unit each have a replaceable cleaning surface situated thereon, the master unit and slave unit each have a plurality of attachment members configured to receive and removably the secure replaceable cleaning surfaces thereon, the housing of the master unit and the housing of the slave unit each further comprise a magnet plate operably affixed to the housing and configured to secure the at least one rare earth magnet beneath the replaceable cleaning surface, the distance between the magnet plates and the replaceable cleaning surfaces is adjustable by an adjustment mechanism operably affixed to the housing and magnet plate of each the slave unit and the master unit, the housing of the master unit further comprises a handle, and the housing of the slave unit has a thickness of less than about one inch.

3. The variable strength magnetic window cleaning device of claim 2, wherein the adjustment mechanism comprises a jack screw.

4. The variable strength magnetic window cleaning device of claim 2, wherein the adjustment mechanism comprises a leaf spring having a detent clip.

5. The variable strength magnetic window cleaning device of claim 2, wherein the handle forms at least a portion of the adjustment mechanism.

6. A variable strength magnetic window cleaning device having, in combination, a master unit and a slave unit magnetically attracted into close proximity wherein the master unit comprises a handle, a first engagement surface, a first rare earth magnet and a second rare earth magnet and wherein the first rare earth magnet and the second rare earth magnet are disposed symmetrically about an X and a Y axis of the first engagement surface, the first rare earth magnet has a north polarity facing the first engagement surface, the second rare earth magnet has a south polarity facing the first engagement surface, the slave unit comprises a second engagement surface and a third engagement surface, a third rare earth magnet and a fourth rare earth magnet and wherein the slave unit has a thickness between the second engagement surface and the third engagement surface of less than about one inch, the third rare earth magnet and the fourth rare earth magnet are disposed symmetrically about an X and a Y axis of the second engagement surface, the third rare earth magnet has a north polarity facing the second engagement surface, the fourth rare earth magnet has a south polarity facing the second engagement surface, such that the first and second rare earth magnets of the master unit magnetically attract the third and fourth rare earth magnets in the slave unit, the third and fourth rare earth magnets are disposed asymmetrically with respect to the midpoint about the thickness of the slave unit and along a plane parallel with the second and third engagement surfaces, the master unit has a first replaceable cleaning surface situated thereon and in contacting engagement with the first engagement surface, wherein the master unit further has a plurality of attachment members configured to receive and removably the secure the first replaceable cleaning surface thereon, the slave unit has a second replaceable cleaning surface situated thereon, and the second engagement surface and third engagement surface are configured for receiving the second replaceable cleaning surface.

7. The variable strength magnetic window cleaning device of claim 6 wherein the first rare earth magnet, second rare earth magnet, third rare earth magnet and fourth rare earth magnet each comprise an array of rare earth magnets.

8. The variable strength magnetic window cleaning device of claim 6, wherein the slave unit further comprises a second replaceable cleaning surface comprising a disposable cleaning wipe sleeve premoistened with a window cleaning solution.

9. The variable strength magnetic window cleaning device of claim 6, wherein the slave unit further comprises a safety cord having a proximal and distal end thereof, and the safety cord is affixed to the slave unit housing on the proximal end and a suction cup on the distal end.

10. The variable strength magnetic window cleaning device of claim 6, wherein the first, second, third and fourth rare earth magnets are magnets selected from the group consisting of Neodymium Iron Boron and Samarium Cobalt.

11. The variable strength magnetic window cleaning device of claim 6, wherein the first, second, third and fourth rare earth magnets comprise Neodymium Iron Boron having a density of about 7.4 g/cm.

12. The variable strength magnetic window cleaning device of claim 6, wherein the first, second, third and fourth rare earth magnets comprise Samarium Cobalt having a density of from about 8.2 to about 8.4 g/cm.

13. The variable strength magnetic window cleaning device of claim 6, wherein first, second and third engagement surfaces each have an exterior peripheral surface comprising a material selected from the group consisting of a rubber like material, polymeric material or silicone and wherein at least a portion of the exterior peripheral surface is textured.

* * * * *